US011236293B2

(12) United States Patent
Ellson et al.

(10) Patent No.: US 11,236,293 B2
(45) Date of Patent: Feb. 1, 2022

(54) MULTI-COMPARTMENT WATER-SOLUBLE CAPSULES

(71) Applicant: Conopco, Inc., Englewood Cliffs, NJ (US)

(72) Inventors: Karen Jane Ellson, Wirral (GB); Duncan Robert Feldman, Liverpool (GB); Mark Leslie Stuffin, Saughall (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 16/347,631

(22) PCT Filed: Oct. 18, 2017

(86) PCT No.: PCT/EP2017/076623
§ 371 (c)(1),
(2) Date: May 6, 2019

(87) PCT Pub. No.: WO2018/086834
PCT Pub. Date: May 17, 2018

(65) Prior Publication Data

US 2019/0316066 A1 Oct. 17, 2019

(30) Foreign Application Priority Data

Nov. 10, 2016 (EP) ..... 16198163

(51) Int. Cl.
*C11D 17/04* (2006.01)
*B65D 65/46* (2006.01)
(Continued)

(52) U.S. Cl.
CPC ..... *C11D 17/045* (2013.01); *B65D 65/46* (2013.01); *B65D 75/323* (2013.01); *C11D 17/043* (2013.01)

(58) Field of Classification Search
None
See application file for complete search history.

(56) References Cited

U.S. PATENT DOCUMENTS 657,495 A 9/1900 Mitchell
657,910 A 9/1900 Barber
(Continued)

FOREIGN PATENT DOCUMENTS

CN 105307941 2/2016
EP 1375637 1/2004
(Continued)

OTHER PUBLICATIONS

Search Report and Written Opinion in PCTEP2017076623 dated Jan. 31, 2018.
(Continued)

*Primary Examiner* — Lorna M Douyon
(74) *Attorney, Agent, or Firm* — Greenberg Traurig, LLP

(57) ABSTRACT

A three-compartment water-soluble capsule, each compartment containing a part of a liquid detergent composition, the compartments being arranged side-by-side to provide a central compartment flanked on respective sides by a first and a second side compartment, the capsule being formed from two sheets of water-soluble film, the two sheets of film being sealed together to form a sealing web around each compartment, the sealing web lying in a sealing plane, each of the three compartments extending at a maximum the same distance above and below the sealing plane, wherein the sealing web comprises an annular sealing web defining the periphery of the capsule, and two internal sealing webs which each extend across the capsule, each internal sealing web serving to connect the central compartment with an
(Continued)

adjacent side compartment and to separate their contents, wherein each internal sealing web has a continuously curved shape.

5 Claims, 10 Drawing Sheets

(51) Int. Cl.
*B65B 9/04* (2006.01)
*B65D 75/32* (2006.01)

(56) References Cited

U.S. PATENT DOCUMENTS 663,069 A 12/1900 Farrell
666,768 A 1/1901 Maugh
681,270 A 8/1901 Shirk
691,326 A 1/1902 Schooley
2015/0136637 A1* 5/2015 Meier ..... B65D 65/46 206/524.7
2015/0267155 A1* 9/2015 Brooker ..... C11D 17/045 8/137
2019/0017001 A1* 1/2019 Camire ..... C11D 3/37

FOREIGN PATENT DOCUMENTS

EP 1394065 3/2004
EP 2617659 A1 * 7/2013
EP 2924104 9/2015
GB 2369083 5/2002
WO WO2014170882 10/2014
WO WO2014202412 12/2014

OTHER PUBLICATIONS

Search Report and Written Opinion in EP16198163 dated May 22, 2017.
Search Report and Written Opinion in EP16198254 dated May 23, 2017.
Search Report and Written Opinion in EP16198264 dated May 23, 2017.
Search Report and Written Opinion in EP16198156; dated May 19, 2017.

* cited by examiner

MULTI-COMPARTMENT WATER-SOLUBLE CAPSULES

TECHNICAL FIELD

This invention relates to multi-compartment water-soluble capsules made from water-soluble film, each compartment containing a part of a detergent composition. Also the manufacture of such capsules and associated manufacturing apparatus, as well as the use of such capsules.

BACKGROUND

Multi-compartment water-soluble detergent capsules made with water-soluble film are known. The water soluble-film is typically polyvinyl alcohol. The preferred capsule manufacturing process involves thermoforming the film. By thermoforming is meant a process in which a first sheet of film is subjected to a moulding process to form recesses in the film. The process involves heating the film to soften it and also the application of vacuum to hold the film in the moulds. The recesses are then filled. The capsules are completed by overlaying a second sheet over the filled recesses and sealing it to the first sheet of film around the edges of the recesses to form a flat sealing web.

Relaxation of the first film typically then causes the applied second sheet to bulge out when the vacuum is released from the first sheet of film in the mould. The capsules are cut apart to leave part of the flat sealing web as an annular "skirt" around each capsule when it is removed from the mould. Although the sealing web is flat when in the mould it may deform a little when removed from the mould. Likewise the profile of the capsule usually relaxes slightly away from having a "mould perfect" profile after it is released from the mould. To the extent that this specification refers to flat sealing webs and/or a sealing plane associated with the sealing web, the reference is to a sealing web that is moulded flat. Similarly, to the extent that this specification refers to aspects of a capsule's shape or configuration, the reference is to capsules that are formed in moulds having that shape or configuration. Nevertheless, some aspects of shape and configuration can be embodied in the capsule itself, for example as a result of the relaxation of the film associated with each compartment, and the effect of the liquid compositions within the compartments. Multi-compartment capsules are suited for delivery of main wash laundry compositions to automatic washing machines and even for hand wash applications. Although a multi-compartment configuration is more difficult to manufacture than a single compartment it may be chosen because components of the detergent composition need to be mixed at point of use and/or have reduced stability when stored together. It may also give the capsule aesthetic appeal because the different compartments can be filled with different coloured contents.

Multi-compartment water-soluble detergent capsules comprising from 2 to 5 compartments obtained by thermoforming a water-soluble film are disclosed in EP1375637 and EP1394065 (Unilever). FIG. 1A of EP1394065 is reproduced here as FIG. 1 and shows a two-compartment capsule 101. Each of the two compartments 102, 103 contains a different part of a cleaning composition and the compartments are connected to each other and separated from one another by at least one flat seal area. One compartment may contain a liquid part of the detergent composition and another compartment a granular part of the composition, such as bleach or builder. A problem with capsules having their compartments separated by a flat sealing web 104 that extends across the capsule as described in most of the embodiments disclosed is that they are floppy because they will fold up along the flat seal, causing a portion of the capsule to droop. This folding has been found to cause handling problems and a floppy capsule is not liked by consumers.

The product sold as "Tide Pods" or "Ariel Pods", is assembled from two thermoformed "capsules" to form a multi-compartment capsule whereby a first "capsule" having two smaller liquid compartments joined together with foldable flat seals is then used to seal (close) a larger compartment. This stacked configuration prevents the seals from folding. However, this approach suffers from the disadvantages of a complex manufacturing process and having a seal area with triple layers of film. To avoid dissolution problems resulting from such triple layer seals it is necessary to use thinner than normal film, which leads to issues with leakage due to pin-holing of the thinner film elsewhere in the capsules during manufacture.

Polyvinylalcohol film cannot completely prevent migration of the contents of one liquid compartment into another. In any capsule where there is a liquid compartment separated from other ingredients only by a single thin layer of polyvinylalcohol film the ability to effectively segregate ingredients that need to be kept apart until use is inevitably compromised. For example in the "Tide Pod" capsule, only the contents of the two smaller liquid compartments can be considered to be effectively segregated.

WO2014/202412 discusses the folding problem in the context of a two compartment capsule containing a liquid composition in a first compartment and granular/powder composition in the other compartment. FIG. 7 of WO2014/202412 is reproduced here as FIG. 2 and shows a rectangular two-compartment capsule 201 wherein two compartments are arranged so as to provide a small inner compartment 202 entirely surrounded by a larger outer compartment 203. The inner compartment contains the granular or powdered composition, and the outer compartment contains the liquid composition. The outer compartment is said to be separated from the inner compartment by a continuous partition seal area which is substantially rectangular and lies in a first plane, the outer compartment having a generally rectangular outer perimeter 204 with rounded corners and a substantially uniform cross-section taken along a plane perpendicular to the first plane and perpendicular (radial) to the inner seal separating the inner and outer compartments. The rectangular skirt 205 corresponds to the cutting pattern used to manufacture the capsule.

WO 2014/170882 (Rideau) discloses three compartment capsules wherein the compartments are arranged such that there is only ever one seal running from one side of the product to the other. The designs usually consist of a central compartment which is not just partnered by side compartments but is actually surrounded by them. This is a solution to the problem of drooping in multi-compartment capsules. The only design where the seal passes from one side to the other without splitting is FIG. 14 which is a dual compartment system. In all other designs a central compartment is used to provide stability against the drooping problem.

The drooping problem applies also to the commercially available "3-in-1" capsule sold by El Corte Ingles (Spain), a schematic illustration of which is provided in FIG. 3. This capsule 301 has a rectangular skirt 302 and three substantially equally-sized, straight-sided compartments 303, 304, 305.

A further "real world" issue with water-soluble detergent capsules, including those used in automatic laundry washing machines, is that consumers do not read the instructions for their use carefully and therefore may use them incorrectly. They are known to put the capsule into the washing machine dispensing drawer when it should be added directly to the drum and they are also known to use capsules in overloaded water conserving washing machines where the capsule may then be exposed to a comparatively small amount of water. And so rapid and complete dissolution of the capsule and mixing of the compositions from different compartments is important. Indeed, incomplete dissolution of the water-soluble film can be a problem particularly where the annular skirt—which is comparatively thick because it is formed from two sheets of film—is wide and/or has substantial corners. Incomplete dissolution can cause film residue to be left on the garments. Indeed, dissolution can be further hampered where, in the early stages of a wash cycle or on placing the capsule on the garments to be washed, the film adheres to a garment because dissolution of the adhered or partially embedded film more difficult. The problem of film sticking or becoming entangled with a garment may be greater if the skirt is wide and/or has substantial corners.

SUMMARY OF THE INVENTION

The present application and the proposals herein seek to address one or more of the problems noted above and/or seek to provide improved capsules especially in connection with material and energy efficiency in production; handling; the consumer experience; and in-use performance.

The present application provides a three-compartment water-soluble capsule, each compartment containing a part of a liquid detergent composition, the three compartments being arranged side-by-side to provide a central compartment flanked on respective sides by a first side compartment and a second side compartment, the capsule being formed from two sheets of water-soluble film, the two sheets of film being sealed together to form a sealing web around each compartment, the sealing web lying in a sealing plane, each of the three compartments extending at a maximum the same distance above and below the sealing plane, wherein the sealing web comprises a generally annular sealing web defining the periphery of the capsule, and two internal sealing webs which each extend across the capsule a machine direction, each internal sealing web serving to connect the central compartment with an adjacent side compartment and to separate the contents of the central and adjacent side compartments, wherein each internal sealing web has a continuously curved shape.

The design of the invention provides a product which is more easily manipulated by the user and also has a more premium feel. Products with many compartments often engender a feeling of over-engineering in that many compartments are include merely for the sake of visual effect. The invention solves this problem by a design which enables the user to hold one of the side compartments and for the product not to fold over on itself. This is particularly problematic when the side compartments are sufficiently sized for a consumer to hold the product by the side compartment and usually results in the product flopping to the extent that the consumer perceives that the product is not sufficiently well made.

The design of the product is limited to multichambered products which have a sealing plane which is substantially in the middle of the product when viewed from the side, along a machine direction. By machine direction is meant the direction of travel during manufacture. In other words, the compartments extend above and below the sealing plane and for a similar amount, i.e. the compartments extend above and below the sealing plane.

Each of the preferred proposals relates to a particular aspect of the shape, structure or configuration of the side-by-side three-compartment water-soluble capsule.

Preferably, the central compartment is significantly larger than each of the side compartments and in particular that the volume of the central compartment is greater than the combined volumes of the side compartments. This can achieve a fuller, plumper shape; better handling and an improved consumer experience.

Preferably, the central compartment is separated from each side compartment by respective sealing webs formed from the water-soluble films, each sealing web having a substantially continuously curved shape. This has been found to resist folding or drooping of the capsule.

Preferably, the three compartments has an outwardly-facing edge whose profile is curved for substantially its entire length. This can contribute to fold or droop resistance and assist in providing a fuller, plumper shape, better handling, improved consumer experience, and better inwash performance. The substantially continuously curved outer edges can be configured so as to, collectively, define a notional circle or oval encompassing all three compartments.

Preferably, the side profile of the central compartment, the side profile being defined by respective sealing webs located between the central and adjacent side compartments. It is proposed that each side profile has a concave recess, and the adjacent side compartments each have a convex portion whose curvature is complimentary to the curvature of the concave recess of the central compartment such that the convex portion is accommodated in the concave recess of the central portion. This achieves efficient packing of the compartments in the available capsule footprint (i.e. within the confines of the cutting pattern), and/or may facilitate rapid dissolution and mixing of the compositions because of the partial "wrapping around" of the central compartment with respect to the side compartment, and the spatial intermingling of the compositions in adjacent compartments. It may also assist mixing and dissolution by encouraging localised agitation of water via water flow along the curved channels formed by the adjacent convex and concave features.

Preferably, the shape of the outer edge profile of the capsule, which is defined by an annular sealing web or skirt that encompasses (in the sealing plane) all three compartments, the skirt having been formed from the bringing together and sealing of the two sheets of water-soluble film so as to define the compartments, and seal-in their contents. It is proposed that the outerwardly-facing edge of the skirt has a hexagonal shape. This may assist efficient manufacture, notably low or no wastage of water-soluble film because of complete tessellation of the hexagon shape. It may also avoid or ameliorate incomplete dissolution of the (comparatively thick) annular sealing web, as well as provide a smoother, less angular appearance in which the annular sealing web is less prominent.

Preferably, in a continuous or semi-continuous production process, filling of one of the compartments, suitably the central compartment, commences a short time before filling of the other compartments. This staggered (in time) arrangement permits efficient filling of capsules in which the arrangement of the central compartment with respect to the side compartments is such that the central compartment spends longer under a filling device than does each of the side compartments. For example, this applies in particular to capsules where the central compartment is significantly larger than each of the side compartments as per the first proposal. This permits the same liquid dispensing rate to be used for all three compartments (and hence the associated dispensing pump systems). Also, efficient filling can be achieved despite different compartment sizes; and without requiring additional filling devices and/or having to move a filling device.

Preferably, in a continuous or semi-continuous production process in which an array of capsules is filled at a filling station, the filling station includes a movable filling device. In particular, the movable device filling device is configured to fill a first capsule in a first column of capsules, move so as to align with a second column of capsules and then fill a capsule in the second column. This is particularly useful in the case whereby adjacent columns overlap, for example in the case where the capsules have a hexagonal shape and the orientation of the hexagons is such that tessellation of the hexagons results in overlap of adjacent columns such that a side compartment from a first column impinges on an adjacent column.

Three-Compartment Capsule

The aspects of the invention described herein provide a three-compartment water-soluble capsule, each compartment containing a part of a liquid detergent composition, the three compartments being arranged side-by-side to provide a central compartment flanked on respective sides by a first side compartment and a second side compartment, the capsule being formed from two sheets of water-soluble film, the two sheets of film being sealed together to form a sealing web around each compartment, the sealing web lying substantially in a sealing plane, wherein each of the three compartments extends above and suitably also below the sealing plane.

FIG. 4 illustrates a capsule according to the present invention. Coordinate axes in the x, y and z direction are shown in FIG. 4 to assist in the explanation of the relative arrangement of features of the capsule. Indeed, FIG. 4 is discussed here to aid understanding of the subsequent discussion of the shape and configuration of the three-compartment capsule of the present invention. The capsule 401 of FIG. 4 comprises lefthand side compartment 402, central compartment 403, and righthand side compartment 404. The three compartments are arranged side-by-side on a notional line extending in the width direction (x direction) across the capsule. Each of the three compartments 402, 403, 404 is elongate in that it has a length (y direction) that is greater than its width (x direction). The long axis of each compartment lies in the y direction.

The sealing web 405 is formed from fusing, e.g. thermoforming, a first and second sheet of water-soluble film during manufacture of the capsule. The sealing web 405 comprises an annular sealing web or skirt 406 that lies in the x-y plane and is referred to herein as the sealing plane. The sealing web 405 also comprises two internal sealing webs 407, 408. These are also in the sealing plane and extend lengthways (in the y direction) down the capsule so as to define the side edges 409, 410 of central compartment 403 and the inwardly-facing side edges 411, 412 of the side compartments 402, 404. Thus the lefthand side compartment 402 and the central compartment 403 are connected to each other and separated from one another by the first internal sealing web 407; and the righthand side compartment 404 and the central compartment 403 are connected to each other and separated from one another by the second internal sealing web 408.

Each of the three compartments 402, 403, 404 extends similarly above and below (z direction) the sealing plane.

It follows that reference herein to the width of a feature (e.g. width of a compartment) is a reference to the dimension in the x direction, that being parallel to the sealing (x, y) plane. Reference herein to the length of a feature (e.g. length of a compartment, or the lengthwise direction or long axis of a compartment) is a reference to the dimension (direction, axis) in the y direction. Reference herein to depth of a feature, or to a feature being, or extending, "above" or "below" is a reference to the dimension (direction, axis) in the z direction, i.e. perpendicular to the sealing plane (x-y plane). Naturally, the terms "above", "below", "up", "down", etc are relative not absolute terms and they are used accordingly herein, and to aid understanding.

In a first aspect corresponding to the first proposal, the central compartment is significantly larger than each of the first and second side compartments.

In a second aspect corresponding to the second proposal, the sealing web comprises a generally annular sealing web defining the periphery of the capsule, and two internal sealing webs which each extend across the capsule, each internal sealing web serving to connect the central compartment with the adjacent side compartment and to separate the contents of the central and adjacent side compartments, wherein each internal sealing web has a substantially continuously curved shape.

In a third aspect corresponding to the third proposal, the sealing web comprises a generally annular sealing web, the annular sealing web defining an outerwardly-facing edge of each of the three compartments, wherein the profile of said outerwardly-facing edge of each of the three compartments is substantially continuously curved. That is, each outwardly-facing edge is curved for substantially its entire length.

In a fourth aspect corresponding to the fourth proposal, the central compartment has a concave recess in each of its side compartment-facing edges, and each side compartment has a convex portion, wherein the convex portion of each side compartment is accommodated in the respective concave recess of the central compartment.

In a fifth aspect corresponding to the fifth proposal, the sealing web comprises a generally annular sealing web or skirt, wherein the outerwardly-facing edge of the annular sealing web is a hexagon. The shape of the outwardly-facing edge of the annular sealing web generally corresponds to the cutting pattern used to separate the capsules prior release from the mould and in such a case the cutting pattern is hexagonal.

In a sixth aspect corresponding to the sixth proposal, the central compartment is substantially elongate, the outer edge of the capsule has a hexagonal shape and the central compartment is arranged so that its long axis is perpendicular to a pair of opposing sides of the hexagon.

In a seventh aspect corresponding to the seventh proposal, there is provided a method of making a capsule as described herein, wherein filling of one of the compartments, suitably the central compartment, commences before filling of the other compartments.

In a eighth aspect corresponding to the eighth proposal, there is provided a method of making a capsule as described herein, wherein an array of moulds comprises at least a first and second column of moulds, and each mould comprises cavities, water-soluble film being provided in each cavity so as to provide recesses to receive a liquid composition, wherein the array of moulds moves in a process direction so as to pass under a filling station and the filling station dispenses liquid composition into the recesses of the moving moulds, wherein at least one filling device of the filling station fills a recess in a mould of the first column, moves substantially perpendicular to the process direction, and then fills a recess in a mould of the second column.

In a ninth aspect, related to some of the previous aspects, the central compartment has an S-shape and each of the side compartments is shaped so as conform to and be at least partially located in a concave recess of the S-shape.

DETAILED DESCRIPTION OF THE INVENTION

Volume

In embodiments the central compartment has a significantly larger volume than each of the first and second side compartments. Volume is conveniently calculated based on the volume of the corresponding cavity in the mould used to make the capsule. Volume includes both liquid composition and any air or other gas that may be present (e.g. arising from headspace from the fill process).

In embodiments the ratio of central compartment volume to each of the first side compartment volume and the second side compartment volume is ≥1.5. In embodiments the ratio is ≥2, ≥2.5, or ≥3:1. In embodiments the ratio is ≤5, ≤4.5, ≤4, or ≤3.5. In embodiments the ratio is about 3.

In embodiments the ratio of central compartment volume to the combined volume of the first and second side compartments is ≥1.2. In embodiments the ratio is ≥1.3, ≥1.4, or ≥1.5. In embodiments the ratio is ≤3, ≤2.5, ≤2, or ≤1.8. In embodiments the ratio is about 1.5.

In embodiments the central compartment volume is ≥10 ml, suitably ≥12 ml, ≥14 ml, ≥16 ml, or ≥17 ml. In embodiments the central compartment volume is ≤30 ml, ≤26 ml, ≤24 ml, ≤22 ml, ≤20 ml or ≤19 ml. In embodiments, the volume of the central compartment is in the range 10 to 22 ml, 12 to 22 ml, 14 to 20 ml, 16 to 20 ml, or 17 to 19 ml.

In embodiments each of the first and second side compartment volumes is independently selected from ≥3 ml, ≥4 ml, ≥5 ml, and ≥6 ml. In embodiments each of the first and second side compartment volumes is independently selected from ≤12 ml, ≤10 ml, ≤9 ml, ≤8 ml, and ≤7 ml. In embodiments each of the first and second side compartment volumes is independently selected from the range 4 to 10 ml, 4 to 9 ml, 4 to 8 ml, 5 to 8 ml, and 5 to 7 ml.

In embodiments the first side compartment volume is substantially the same as the second side compartment volume. In such embodiments, suitably the volume of each side compartment is in the range 4 to 9 ml, or 5 to 7 ml.

In embodiments, the total compartment volume (total volume of all three compartments) is ≥10 ml, ≥15 ml, ≥20 ml, ≥22 ml, ≥24 ml, ≥26 ml or ≥28 ml. In embodiments the total compartment volume (total volume of all three compartments) is ≤40 ml, ≤38 ml, ≤36 ml, ≤34 ml, ≤32 ml, ≤30 ml, ≤28 ml, ≤26 ml or ≤25 ml. In embodiments the total compartment volume (total volume of all three compartments) is in the range 15 to 36 ml, 20 to 36 ml, 22 to 36 ml, 24 to 34 ml, 28 to 32 ml, or 22 to 26 ml.

In embodiments the central compartment volume is in the range 16 to 20 ml; the first and second compartment volumes are substantially the same and are in the range 4 to 9 ml.

Regarding the extent of fill (fill level), in embodiments the amount of liquid detergent composition as a % of total volume of any given compartment is at least 60%, suitably at least 70%, 80% or 90%, preferably at least 92%, 94%, 96% or 98%. Suitably the % is substantially the same for all three compartments.

Dimensions and Shape

In embodiments each of the three compartments extends above the sealing plane such that the part of each compartment that is furthermost from the sealing plane, in a direction perpendicular to the sealing plane, is Zn, wherein n=1 denotes the first side compartment, n=2 denotes the central compartment, and n=3 denotes the second side compartment, wherein Z2>Z1 and Z2>Z3. In embodiments, Z2≥1.1×Z1 and ≥1.1×Z3; Z2≥1.2×Z1 and ≥1.2×Z3; Z2≥1.3×Z1 and ≥1.3×Z3; Z2≥1.4×Z1 and ≥1.4×Z3; or Z2≥1.5×Z1 and ≥1.5≥Z3.

In embodiments each of the compartments extends ≥5 mm, ≥6 mm, ≥7 mm, ≥8 mm, or ≥9 mm, and suitably ≤30 mm, ≤25 mm or ≤22 mm above the sealing plane, as measured in a direction perpendicular to the sealing plane. In embodiments each compartment extends ≥5 mm, ≥6 mm, ≥7 mm, ≥8 mm, or ≥9 mm, and suitably ≤30 mm, ≤25 mm or ≤22 mm below the sealing plane. As noted elsewhere, the terms "above" and "below" are relative not absolute terms and are used accordingly; here they can be understood to refer to opposite directions perpendicular to the sealing plane.

In the case of the central compartment, in embodiments the central compartment extends ≥9 mm, ≥10 mm, ≥11 mm, ≥12 mm, ≥14 mm or ≥16 mm, but suitably ≤30 mm, ≤25 mm, or ≤22 mm above the sealing plane; and suitably ≥9 mm, ≥10 mm, ≥11 mm, ≥12 mm, ≥14 mm or ≥16 mm, but suitably ≤30 mm, ≤25 mm, or ≤22 mm below the sealing plane.

In embodiments, the first and second side compartments each extend at least 5 mm above and below the sealing plane, and the central compartment extends at least 10 mm above and below the sealing plane.

In embodiments each of the compartments is substantially symmetrical about the sealing plane.

In embodiments the first side compartment has substantially the same shape as the second side compartment. The orientation of the of the first side compartment shape can be the same or different than the orientation of the second side compartment shape. In embodiments the first and second compartments have substantially the same shape and different orientations such that the first side compartment shape is inverted with respect to the second side compartment shape.

In embodiments the capsule has a maximum linear dimension of ≥40 mm, suitably ≥50 mm, ≥60 mm, ≥70 mm or ≥75 mm. In embodiments the maximum linear dimension is ≤100 mm, suitably ≤90 mm, ≤85 mm, or ≤80 mm. For example, in the case of embodiments in which the capsule has a hexagonal shape then the maximum linear dimension corresponds to the distance between opposing vertices of the hexagon.

In embodiments, the maximum linear dimension of the capsule is in the sealing plane, which suitably corresponds to the diameter of the capsule.

Regarding the dimensions of the compartments, in embodiments each compartment has a maximum linear dimension independently selected from ≥20 mm, ≥25 mm, ≥30 mm and ≥35 mm. In embodiments, each compartment has a maximum linear dimension independently selected from ≤85 mm, ≤80 mm, ≤75 mm, ≤70 mm, ≤68 mm, and ≤66 mm.

Side Compartments

In embodiments at least one, preferably both, of the side compartments has a bulbous end portion and a tapered end portion.

In embodiments where both side compartments have said bulbous and tapered end portions, suitably the side compartments are inverted relative to each other such that the bulbous end portion of the first side compartment is located adjacent one end portion of the central compartment and the bulbous end portion of the second side compartment is located adjacent the opposite end portion of the central compartment.

In embodiments each of the first and second side compartments have a shape, in cross-section in the sealing plane (i.e. as defined by the annular sealing web and internal sealing web), which is teardrop-shaped. Suitably the teardrop-shape of the first side compartment is inverted with respect to the teardrop-shape of the second side compartment.

In embodiments the first and/or second side compartment(s) has a maximum linear dimension of ≤55 mm, ≤50 mm, ≤48 mm, or ≤46 mm. Typically the maximum linear dimension is the maximum linear dimension in the sealing plane, e.g. the long axis of the teardrop-shape. Suitably this corresponds to the length of the side compartment (y direction).

Central Compartment

In embodiments, the central compartment has first and second relatively wide end regions, suitably bulbous end regions, and a relatively narrow central region interconnecting the said relatively wide end regions.

In embodiments, when viewed side-on, in cross-section perpendicular to the sealing plane, the central compartment has bulbous end regions and a relatively narrow central region interconnecting the said bulbous end regions.

In embodiments, when viewed in plan, in cross-section in the sealing plane, the central compartment has bulbous end regions and a relatively narrow central region interconnecting the said bulbous end regions.

In embodiments the bulbous end regions each have a width (i.e. in the sealing plane) and a depth (i.e. perpendicular to the sealing plane) that is larger than the width and depth respectively of the central region.

This may provide the central compartment with a dumbbell-like configuration. This serves to provide the consumer with a pleasing tactile and visual experience. It permits the maximum depth (z direction) of the capsule to be slightly reduced as compared to, for example, a simple rectangular compartment where the maximum depth is at a single point in the central region of the compartment. This configuration can assist in providing a curvaceous capsule with surprisingly modest dimensions. This in turn can assist in providing a higher packing density of capsules when provided in consumer packaging; and hence associated advantages in packaging and transport costs and energy requirements.

It also serves to provide comparatively deep (z direction) regions towards the edge/periphery of the capsule, which is something that is not achieved with conventional configurations. It may impart stability to the capsule when placed on a flat level surface, for example when placed temporarily on a kitchen or bathroom worktop, or in the bottom of the container in which the capsules were provided. In particular, the bulbous ends of the central compartment may prevent or reduce "wobble" associated with conventional pillow-like configurations, which may be prone to tip over or tilt when placed on a flat, level surface. On the other hand if the conventional configurations have a lower extent of fill and/or a more mechanically pliant configuration, they may under their own weight squash into/conform to the surface, making it more likely that they will stick to the surface, especially if the surface is damp. This in turn can lead to increase likelihood of rupture. Even if rupture does not occur, the user may perceive a stickiness, or resistance, when removing the capsule from the surface. A related problem noted herein is that residues of the film can be retained on a garment as a result of the capsule sticking to the garment and the consequential increased difficulty in dissolving the adhered film. Whereas the provision of multiple sites of engagement, which in embodiments correspond to the said bulbous regions, may decrease the likelihood of sticking to a surface.

The provision of bulbous end regions may improve firmness and plumpness of the capsule, for example due to the greater stretch and fill volume imposed on the water-soluble film at those end (peripheral) regions.

It may also provide a greater external surface area for interaction with water in the washing machine. That is, in simple terms, the composition in any one of the three compartments is never far from the water. By selectively locating the composition at outer or peripheral locations, there is less composition "buried" in the middle of the capsule. This in turn aids rapid dissolution and/or dispersion of both the water-soluble film and the liquid detergent composition.

As for the extent to which the bulbous end regions are deeper (z direction) than the central region, in embodiments the distance which a bulbous end portion extends above and/or below the sealing plane, as measured perpendicularly to the sealing plane, is at least 10%, 20% or 30% greater than the corresponding distance of the central region. As regards absolute values, in embodiments the distance for one or each of the bulbous end portions is at least 1 mm, at least 2 mm or at least 3 mm greater than the corresponding distance of the central region.

As for the extent to which the bulbous end regions are wider (x direction) than the central region, in embodiments the width of each bulbous end portion as measured in the sealing plane, is at least 10%, 20% or 30% greater than the width of the central region. As regards absolute values, in embodiments the each of the bulbous end portions is at least 1 mm, at least 2 mm or at least 3 mm greater than the width of the central region.

Suitably the bulbous regions are substantially the same depth or deeper (z direction) than the side compartments. That is, substantially the same or greater than the distance by which each side compartment extends from the sealing plane in a direction perpendicular to that plane.

In the case of a dumbbell-like configuration in the sealing plane, this configuration provides recesses formed in opposite sides of the central compartment, which recesses can accommodate the adjacent side compartments, in particular a bulbous region of a side compartment. In embodiments the recess on one side of the central compartment is offset from the recess on the opposite side of the central compartment. This staggering or offsetting of the recesses permits a corresponding staggering or offsetting of bulbous portions of the side compartments. This in turn serves to locate the liquid compositions in a manner that may facilitate more rapid mixing of the liquid compositions in use.

The dumbbell-like configuration—bulbous end portions and a narrower, necked central portion—in both depth and width directions, may provide the central compartment with a saddle region on one or both of the upper and lower surfaces of the capsule. Again, this may contribute to a more rounded and smoothly contoured product, thereby providing favourable visual and tactile cues.

Indeed, it is generally preferred that the central compartment has, in the sealing plane, a shape whose respective side edges define a concave region. Suitably the respective side edges define both a concave region and a convex region.

The central compartment may have an S-shape, and in particular an S-shaped cross-section in the sealing plane. The S-shape provides, on each side of the "S", concave regions or recesses, and corresponding convex regions on the immediately opposite side of the "S". In embodiments the S-shape accommodates, in each of its two concave regions, at least a portion of the respective side compartments. Suitably the side compartments each have a bulbous portion as described herein and it is this bulbous portion that is accommodated in the concave region or recess. Indeed, suitably each of the first and second side compartments has a convex portion whose curvature substantially conforms to the curvature of the concave parts of the central compartment.

Additionally or alternatively, the convex portions of the central compartment (suitably the convex portions of the S-shape) can accommodate correspondingly curved portions of one or both side portions. In particular, where the side compartments comprise a tapered portion as described herein, suitably including (tapering to) a pointed end portion, the tapered portion is accommodated alongside the convex portion of the central compartment. Suitably the curvature of the tapered portion substantially conforms to the curvature of the convex portion of the central compartment.

In embodiments each side compartment has a concave portion, typically formed by the tapered portion, and the convex portion of the central compartment is accommodated by the concave portion of the side compartment.

In embodiments, the extent of curvature of a concave recess or convex portion as described herein is such that the radius of curvature of the concave recess or convex portion is in the range 10 mm to 25 mm or 12 mm to 22 mm.

This configuration, and the effect of at least partially wrapping around or enveloping one or both side compartments by the central compartment, and vice versa, may assist the mixing of the three liquid compositions from each of the central and side compartments. The configuration may also convey to the consumer, visually and when handled, that the three compositions are located with respect to each other so as to assist mixing.

Provision of both a curved sealing web and a bulbous end region in adjacent central and side compartments may further contribute to anti-droop. Furthermore, close proximity of bulbous, highly stretched and filled regions of adjacent central and side compartments may also impart greater resistance to droop. Furthermore, the anti-droop effect may be further enhanced where the said two recesses on respective opposite sides of the central compartment (e.g. formed as concave portions) are offset so as to be located in respective opposite end regions of the central compartment, i.e. provided at positions offset from a notional line extending transversely across the capsule.

The Three Compartments

In embodiments the outerwardly-facing edges of each of the three compartments are curved, suitably substantially continuously curved.

In embodiments, the curvature and arrangement of said outerwardly-facing edges is such as to define an approximate notional circle. In embodiments the curvature of at least a major portion of each of the outerwardly-facing edges of each compartment substantially conforms to the curvature of the notional circle.

The side-by-side configurations described herein may assist in rapidly providing, in a washing machine, a wash liquor containing all three parts of the liquid detergent composition. Specifically, when placed approximately flat on top of e.g. dirty garments in the drum of a washing machine, the subsequent rising water level caused by (partial) filling of the drum with water at the start of the was cycle may cause simultaneous dissolution and/or dispersion of all three parts of the liquid composition from their respective compartments. Even if water is introduced into the drum in other ways, it is likely that all three compartments will be presented to the recently introduced water so that dissolution and dispersion of all three compartments and their contents begin at approximately the same time. Similarly, for those wash cycles whereby the drum is moved during the filing stage so as to agitate the garments, the capsule will, even if upturned, present all three compartments to the water.

A further advantage of the side-by-side configurations described herein is that only two sheets of water-soluble film are required in order to provide three compartments. Furthermore, for each of the three compartments, a significantly greater surface area is presented such that more rapid dissolution might be achieved as compared to, for example, capsules that require three layers of water-soluble film and/or where compartments have a wall or significant surface in common, which wall or surface is not accessible to the water, resulting in slower and/or unequal dissolution and/or dispersion of the compositions, and the wall material, in use.

In embodiments the ratio of areas in the sealing plane of the central compartment to the side compartments is from 10:1 to 1:1, from 5:1 to 1:1, from 3:1 to 1:1 from 3:1 to 1.2:1, from 3:1 to 1.4:1, or from 2.5:1 to 1.5:1.

The Water-Soluble Film

As described herein two water-soluble films are used to make the capsule: a first film is applied to the cavity of the mould to form recesses, the recesses are filled with liquid composition and a second film is applied to the filled recesses so as to seal-in the liquid compositions and thereby form the compartments.

In embodiments the first film thickness (pre-thermoforming) is from 50 to 150 micrometer, from 60 to 120 micrometer, or from 80 to 100 micrometer. After capsule manufacture generally the average thickness of the first film will be from 30 to 90 micrometer, or from 40 to 80 micrometer.

The second film is typically of a similar type to that used for the first film, but slightly thinner. Thus, in embodiments, the second film is thinner than the first film. In embodiments the ratio of thickness of the first film to the thickness of the second film is from 1:1 to 2:1.

In embodiments the second film thickness (pre-thermoforming) is from 20 to 100 micrometer, from 25 to 80 micrometer, or from 30 to 60 micrometer.

In embodiments the water-soluble film comprises polyvinyl alcohol or a polyvinyl alcohol derivative. Such film materials can for example be produced by a process of blowing or casting.

The water-soluble film can also contain plasticizers, anti-foams, anti-oxidants, surfactants, perfumes and the like.

Suitable films include Monosol M4045 and Monosol M8045 (75, 82, 88 & 90 micron) and Aicello PT films (PT 75 & 90).

Sealing Web

In embodiments the sealing web comprises a generally annular sealing web encompassing all three compartments, and two internal sealing webs which each extend across the capsule, each internal web serving connect and space apart the central compartment and an adjacent side compartment.

Skirt/Annular Sealing Web

In embodiments the annular sealing web or skirt has an area of ≤1500 $mm^2$, ≤1400 $mm^2$, ≤1300 $mm^2$, ≤1200 $mm^2$, ≤1100 $mm^2$, or ≤1000 $mm^2$. A smaller skirt area (also known as flange area) is desirable for the reasons explained herein, namely reduced wastage and reduced likelihood of undesirable residue, as well as improved consumer perception and handling experience.

In embodiments the maximum width of the skirt is ≤12 mm, ≤10 mm, ≤9 mm, ≤8 mm, or ≤7 mm. The width of the annular sealing web is, at any one location on the periphery of the capsule, the distance between the outermost edge of the compartment that defines the inner edge of the annular web at the said location and the outermost edge of the annular web at the said location, measured radially on a notional line extending from the centre of the capsule in the sealing plane, to the said outermost edge.

Whilst a narrower skirt is desirable for aesthetic and performance reasons, it is nevertheless important that a robust seal is provided and so, in embodiments the maximum width of the annular sealing web is ≥1 mm, ≥2 mm or ≥3 mm.

In embodiments where the outerwardly-facing edge of the annular sealing web is a hexagon, suitably the width of the annular sealing web along at least a major portion of each side of the hexagon is ≤7 mm, ≤6 mm, ≤5 mm, or ≤4 mm. Suitably the said major portion of each side of the hexagon is at least 55% of the length of the side of the hexagon, preferably at least 60%. In this way, the width of the annular sealing web (skirt) can be narrow around the majority of the perimeter of the capsule, further assisting in providing a pleasing tactile and visual cue to the consumer as well as minimising the amount of water-soluble film used.

Indeed, more generally and independently of the shape of the outerwardly-facing edge of the annular sealing web, it is preferred that the width of the annular sealing web is, for the major portion of the perimeter of the capsule, ≤7 mm, ≤6 mm, ≤5 mm, or ≤4 mm. Suitably the said major portion of the perimeter of the capsule is at least 55% of the perimeter length, preferably at least 60%.

In embodiments the outerwardly-facing edge of the annular sealing web is a hexagon. The hexagon can be a regular or an irregular hexagon. Suitably the hexagon is a regular hexagon (all sides having equal length).

The annular sealing web or skirt defining the periphery of the capsule and hence provides the capsule with a hexagon shape.

In embodiments the side length for each side of the hexagon is ≥20 mm, ≥25 mm, ≥28 mm, ≥30 mm, ≥32 mm, ≥34 mm, ≥35 mm or ≥37 mm. In embodiments the side length for each side of the hexagon is ≤50 mm, ≤45 mm, ≤43 mm, ≤41 mm, or ≤40 mm. In embodiments the side length for each side is in the range 30 mm to 45 mm, 32 mm to 42 mm, or 35 mm to 40 mm.

As noted above, suitably the hexagon is a regular hexagon and in embodiments the regular hexagon has a side length in the range 37 mm to 42 mm, for example about 39 mm.

Other shapes are also envisaged, for example a square, circle and oval.

Internal Sealing Webs

In embodiments at least 90% of the length of each internal sealing web is curved, preferably at least 95%, more preferably substantially all of each internal sealing web is curved. The length of each internal sealing web is measured between respective end points where the internal sealing web joins (becomes) the annular sealing web at the "top" and "bottom" of the capsule.

In embodiments each internal sealing web has, in the sealing plane, a substantially continuously curved shape.

In embodiments the internal sealing web is substantially free of straight portions.

In embodiments, at least a portion of each internal web has a curved profile whose radius of curvature is in the range 10 mm to 25 mm or 12 mm to 22 mm.

In embodiments the width (i.e. in the sealing plane) of each internal sealing web is substantially constant. In embodiments the width of each internal sealing web is ≤3 mm, or ≤2 mm.

In embodiments the spacing between the two internal sealing webs is such that there is a first spacing at each of the outer (suitably bulbous) ends of the central compartment, and a second spacing at the central (e.g. comparatively narrow, necked) region of the central compartment, wherein the or each first spacing is larger than the second spacing. That is, suitably the spacing between the two internal sealing webs decreases as the internal sealing web traverses the capsule from an outer (start) position where it extends from the annular sealing web to a radially inner position approximately at the midpoint of the length of the internal sealing web. Suitably this reduction in inter-web spacing contributes to the anti-droop effect.

In embodiments the extent of change of spacing between the internal sealing webs is ≥10%, ≥15%, ≥20%, ≥25%, or ≥30%. A 10% value being a 10% decrease as compared to the first (outer end) spacing, e.g. a 30 mm spacing at the outer end of the central compartment, narrowing to 27 mm at the midpoint of the internal sealing webs. In absolute terms the change of spacing between internal sealing webs is suitably in the range 1 to 15 mm, 1 to 12 mm, 2 to 12 mm, 4 to 12 mm, 5 to 12 mm, 6 to 12 mm, or 8 to 12 mm.

Rotational Symmetry

In embodiments the capsule has approximate rotational symmetry (point symmetry), suitably second order rotational symmetry, rotation being in the first (sealing plane). Suitably the origin is the capsule's centre point in the sealing plane. And so, in embodiments, rotation of the capsule by 180 degrees around its centre point will superpose the rotated compartments on the pre-rotation compartments. This is a characteristic of the preferred inverted side compartments and the oppositely configured convex and concave features of the central compartment.

This may also contribute to the consumer's favourable perception of the capsule and/or remove any notion of "right way up" because the capsule will look the same when viewed from different directions.

In embodiments the capsule has no plane of symmetry (mirror or reflection symmetry) other than (optionally) the sealing plane. In particular, as will be clear from the discussion herein regarding preferred configurations for the central and side compartments, the capsule suitably has no plane of symmetry in a plane perpendicular to the sealing plane.

Tessellation

In embodiments the footprint of the capsule, as defined by the outer edge of the annular sealing web, is capable of being tessellated. This avoids wastage of the water-soluble film in production of the capsules.

In embodiments the capsule has a 6-sided, i.e. hexagonal, shape. The hexagon can be approximately a regular hexagon (all sides being of approximately equal length; all internal angles approximately equal).

Tessellation is relevant to the method of producing the capsule, and in particular to the efficiency, at least in terms of material usage, of the method.

The present inventors have found that a hexagon provides an excellent balance between efficient production, consumer perception, and rapid and complete dissolution of water-soluble film in use. Regarding efficient production, at least material wastage and the relative complexity and reliability of the cutting stage, are relevant factors.

In this connection, as noted above, commercially available capsules—including "stacked" 3-film capsules as well as 2-film capsules—have a square or rectangular footprint (cutting pattern) and this is efficient in terms of avoiding wastage during manufacture, because the square or rectangle can readily be arranged in a two dimensional array, for example on a tray of moulds, or on a continuously moving surface bearing an array of moulds, such as the surface of a rotating drum. The cutting stage is straight forward because only one set of vertical cuts and one set of horizontal cuts is required.

However, even if the compartment(s) of such rectangle-footprint capsules are themselves rounded, consumers perceive the rectangle shaped footprint as unattractive. As noted herein, this may put some consumers off adopting capsules, thereby prolonging the problems of spillage and incorrect dosage that is associated with user-dispensed compositions. In such capsules the prominent corners of the skirt are not only unattractive but are also comparatively large such that they may not completely dissolve, especially as they are more prone to stick to garments in the initial phase of a wash cycle, which makes incomplete dissolution even more likely.

To try to ameliorate the effects of the rectangle-shape, the corners can be rounded. However, this adds to the complexity of the cutting step and also produces waste in the form of small offcuts.

On the other hand, circular footprint capsules have been commercially available, and are regarded by consumers as attractive and appropriate. But they suffer from considerable cutting complexity and wastage.

The present inventors have found that a hexagonal shape provides an excellent solution to the apparently conflicting requirements of the consumer and the production process. The hexagonal shape tessellates such that there is no wastage. Tessellation is achieved both in the case where opposing vertices (points) of the hexagon are aligned so as to be at the notional top and bottom of the capsule (when the mould is seen in plan view; see FIG. 4); and in the case where opposing sides of the hexagon are aligned so as to be at the notional top and bottom of the capsule (when the mould is seen in plan view; see FIG. 4).

The vertices of the hexagon, because of the larger internal angle as compared to the corner of a square, are not as noticeable to the consumer. Furthermore, the larger internal angle can more easily accommodate part of a compartment. That is, a compartment can get further into a vertex; the vertex provides a more usable space. Furthermore, the provision of six sides also "softens" the overall impression of the capsule and approximates a circular shape.

Indeed, when the capsule is released from the mould (e.g. when the vacuum is switched off such that the capsule is no longer forced to conform to the shape of the mould) the strict hexagon shape softens as a result of internal forces in the sheets of water-soluble film. The film seeks to some extent to relax back into its original shape after the thermoforming process and this can to some extent distort the capsule so that it is no longer identical to the shape of the mould. This, together with the filling of the compartments, can cause gathering-up, or wrinkling, of the annular sealing web, such that the vertices in particular are less noticeable. It also appears to make it less likely that the consumer will discern discrete sides. Rather, the consumer perceives that the outer edge of the annular sealing web conforms to the shape of the outer edges of the compartments. As noted herein, in embodiments the shape and configuration of the three compartments is selected so that the outer edges of those compartments cooperate in a generally contiguous and approximate manner to define a notional circle or oval. Thus, a hexagonal footprint in combination with the preferred arrangement of the three compartments presents the consumer with a capsule that is perceived as circular or oval. As a result, there is no need to trim or round the vertices and so no wastage.

The cutting step is admittedly more complex than for a square footprint, but considerably less so than for a circular footprint. Analogous to the square footprint, only straight cuts are required. Three pairs of cutting blades can be provided, and in use engage the periphery of the mould, so as to produce respective opposing sides of the hexagonal annular sealing web of the capsule. The three pairs of blades can operate simultaneously, so as to produce all six sides at substantially the same time, or sequentially, so as to produce respective pairs of sides in sequence.

In embodiments a mould is provided with recesses corresponding to the location and orientation of the blades, and hence the desired hexagonal shape of the annular sealing web. In this way the blades and/or the water-soluble film may enter a short distance into the respective recesses to facilitate the efficient cutting of the water-soluble film and/or to prevent direct impact of the blades against a surface of the mould.

Thermoforming Process

The three-compartment capsule is produced by a process of thermoforming. Such a process may advantageously comprise the following steps to form the three-compartment capsule:

(a) placing a first sheet of water-soluble polyvinyl alcohol film over a mould having sets of cavities, each set comprising three cavities arranged side-by-side;

(b) heating and applying vacuum to the film to mould the film into the cavities and hold it in place to form three recesses in the film; a first side recess, a central recess, and a second side recess, the central recess being connected to respective side recesses by the film;

(c) filling three different parts of a liquid detergent composition into the side and central recesses, the parts together forming a full detergent composition;

(d) sealing a second sheet of film to the first sheet of film across the formed recesses to produce a three compartment capsule having first and second side compartments located on opposite sides of a central compartment such that the central compartment is flanked by respective first and second side compartments, wherein the three compartments are connected to each other and separated by a continuous sealing web;

(e) cutting between the capsules so that a series of three compartment capsules are formed, each capsule containing a part of a detergent composition in three compartments (one central and two side compartments).

As discussed herein, the cutting (step (e)) suitably includes cutting according to a hexagonal cutting pattern. In embodiments this step includes providing a cutter configured to provide simultaneous or sequential cuts corresponding to each of the six sides of the hexagon. In embodiments, the cutter has 3 pairs of parallel blades to effect cutting of respective pairs of opposing sides of the hexagon.

Sealing can be done by any suitable method for example heat-sealing, solvent sealing or UV sealing. Particularly preferred is water-sealing. Water sealing may be carried out by applying moisture to the second sheet of film before it is sealed to the first sheet of film to form the seal areas.

A preferred thermoforming process uses a rotary drum on which the forming cavities are mounted. A vacuum thermoforming machine that uses such a drum is available from Cloud LLC. The capsules according to the invention could also be made by thermoforming on a linear array of cavity sections. Machines suitable for that type of process are available from Hoefliger. The following example description is focused onto the rotary process. A skilled person will appreciate how this would be adapted without inventive effort to use a linear array process.

Liquid Detergent Composition

The liquid detergent composition may be any type of cleaning composition for which it is desirable to provide a dose thereof in a water-soluble capsule. The three-compartment capsules comprise three different parts of the detergent composition. All three parts are liquid.

Suitable detergent compositions that may be split into different components for use in the present invention include those intended for laundry (fabric cleaning, softening and/or treatment) or machine dishwashing. Preferred are laundry compositions, particularly laundry cleaning compositions.

The three compartment capsules comprise three different parts of a detergent composition which, when combined, make up the full detergent composition. By that is meant that the formulation of each of the parts of the detergent composition is different either in its physical form (e.g. viscosity), its composition or its colour. Sometimes it will be sufficient to only have minor differences between the parts of the detergent composition e.g. colour, perfume etc. Often, however, it will be advantageous to have visible differences.

The central compartment may comprise sequestrants, enzymes, bleach catalysts, perfume, builders etc.

The central and side compartments of the three-compartment capsule will be filled with liquids. By filled it is meant that the compartment contains liquid and possibly also a gas bubble. The presence of the gas bubble provides some protection from compression of the compartment due to its compressibility. The gas is preferably air trapped in the compartment during manufacture.

The liquid-containing compartments are separated by the sealing web as described herein.

Preferred liquids have a viscosity in the range 100 to 1000 cPs.

The liquid composition in each of the compartments preferably has a low water content of less than 10 wt %, more preferably from 0.5 to 9 wt % water, most preferably from 1 to 7 wt %.

Surfactant

The detergent composition may comprise one or more organic surfactants. Many suitable detergent-active compounds are available and are fully described in the literature, for example, in "Surface-Active Agents and Detergents", Volumes I and II, by Schwartz, Perry and Berch. The organic surfactant may be anionic (soap or non-soap), cationic, zwitterionic, amphoteric, nonionic or mixture of two or more of these. The preferred organic surfactants are mixtures of soap, synthetic non-soap anionic and non ionic compounds optionally with amphoteric surfactant.

Anionic surfactant may be present in an amount from 0.5 to 50 wt %, preferably from 2 wt % or 4 wt % up to 30 wt % or 40 wt % of the detergent composition. Suitable examples include alkyl benzene sulphonates, particularly sodium linear alkyl benzene sulphonates having an alkyl chain length of C5-C15; olefin sulphonates; alkane sulphonates; dialkyl sulphosuccinates; and fatty acid ester sulphonates.

Suitable nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide. Specific nonionic surfactant compounds are alkyl (C8-22) phenol-ethylene oxide condensates, the condensation products of linear or branched aliphatic C8-20 primary or secondary alcohols with ethylene oxide, and products made by condensation of ethylene oxide with the reaction products of propylene oxide and ethylene-diamine.

In a fabric washing detergent composition, these organic surfactants preferably comprise 5 to 50 wt % of the detergent composition. In a machine dishwashing composition, organic surfactant is likely to constitute from 0.5 to 8 wt % of the detergent composition and preferably consists of nonionic surfactant, either alone or in a mixture with anionic surfactant.

Builders and Sequestrants

The detergent compositions may contain a so-called detergency builder which serves to remove or sequester calcium and/or magnesium ions in the water. Soluble builder may be added to the liquid composition. For example sodium citrate or a soluble sequestrant, for example, Dequest 2066, which may also assist with stabilising the liquid.

The builder or sequestrant material is preferably fully soluble so as to eliminate the possibility of unwanted and unsightly residues on fabrics. For that reason Alkali metal aluminosilicates are not favoured.

Non-phosphorus water-soluble detergency builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di and trisuccinates, carboxymethyloxysuccinates, carboxymethyloxymalonates, dipicolinates and hydroxyethyliminodiacetates. Electrolytes such as sodium carbonate are not preferred due to the way they suppress the solubility of polyvinylalcohol.

Bleach System

The detergent composition may contain a bleach system. This preferably consists of an air bleaching catalyst. For example the catalyst being a ligand of the formula (I) complexed with a transition metal, selected from Fe(II) and Fe(III), (I)

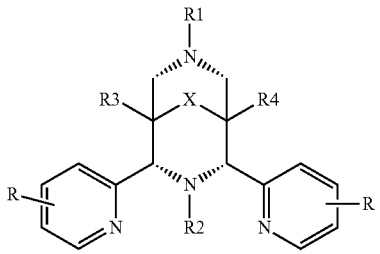

Where R1 and R2 are independently selected from:
C1-C4-alkyl,
C6-C10-aryl, and,
a group containing a heteroatom capable of coordinating to a transition metal, wherein at least one of R1 and R2 is the group containing the heteroatom; preferably at least one of R1 or R2 is pyridin-2-ylmethyl. More preferably the catalyst is one in which R1 is pyridin-2-ylmethyl. Most preferably R1 is pyridin-2-ylmethyl and R2 is methyl;
R3 and R4 are independently selected from hydrogen, C1-C8 alkyl, C1-C8-alkylene-O—C1-C8-alkyl, C1-C8-alkylene-O—C6-C10-aryl, C6-C10-aryl, C1-C8-hydroxyalkyl, and —(CH2)nC(O)OR5;
wherein R5 is independently selected from: hydrogen, C1-C4-alkyl, n is from 0 to 4, and mixtures thereof; preferably R3=R4=—C(O)OMe and,
each R is independently selected from: hydrogen, F, Cl, Br, hydroxyl, C1-C4-alkyO—, —NH—CO—H, —NH—CO—C1-C4-alkyl, —NH2, —NH—C1-C4-alkyl, and C1-C4-alkyl; preferably each R is hydrogen,
X is selected from C=O, —[C(R6)2]y- wherein Y is from 0 to 3, preferably 1, each R6 is independently selected from hydrogen, hydroxyl, C1-C4-alkoxy and C1-C4-alkyl preferably X is C=O.

Most preferably the catalyst is ([Fe(N2py3o)Cl]Cl) with structure (II):

(II)

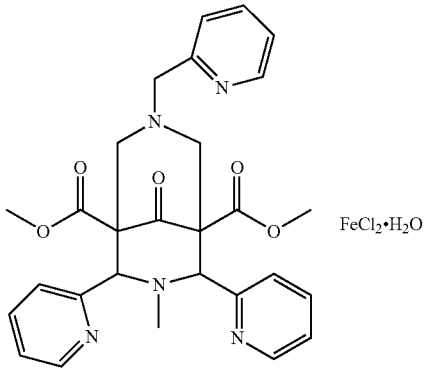

Also known as Iron(1+), chloro[rel-1,5-dimethyl (1R,2S,4R,5S)-9,9-dihydroxy-3-methyl-2,4-di(2-pyridinyl-kN)-7-[(2-pyridinyl-kN)methyl]-3,7-diazabicyclo[3.3.1]nonane-1,5-dicarboxylate-kN3, kN7]-, chloride (1:1), (OC-6-63)[CAS Registry Number 478945-46-9].

To avoid possible gassing of ingredients it is preferred to avoid the use of persalt or peracid bleaching species in the capsules.

Further Optional Ingredients

Detergency enzymes may be employed in the compositions.

The compositions may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included when organic surfactant is present; especially if the detergent composition is primarily intended for use in front-loading drum-type automatic washing machines. Soap is a suitable antifoam.

Further ingredients which can optionally be employed in laundry detergent compositions of the invention include antiredeposition agents such as sodium carboxymethylcellulose, straight-chain polyvinyl pyrrolidone and the cellulose ethers such as methyl cellulose and ethyl hydroxyethyl cellulose, fabric-softening agents; perfumes; and colorants or coloured speckles.

Use of Capsules

The capsules described herein are suitable for use in a cleaning method, suitably a laundry method. Thus, a further aspect of the present invention provides use of capsules as described herein in a method of cleaning, suitably a laundry method. Suitably the method includes placing the capsule in the drum of a washing machine prior to commencement of a wash cycle.

The three-compartment capsules are particularly suitable for use in (fabric) washing machines and in dishwashing machines amongst other applications. They can also be used in manual laundry and dishwashing operations. In use the capsules according to the invention are preferably, and conveniently, placed directly into the liquid which will form the wash liquor or into the area where this liquid will be introduced. The capsule dissolves on contact with the liquid, thereby releasing the detergent composition from the separate compartments and allowing them to form the desired wash liquor.

It is a particular advantage of the capsules that they may alternatively be placed into a dispensing drawer of the type found in automatic laundry washing machines where water flows through the drawer. Surprisingly the capsules have been found to dispense effectively from such drawers.

Package Containing Capsules

The three-compartment capsules described herein can be provided in any suitable packaging, for example a box or other container. Thus, a further aspect of the present invention provides a package containing a plurality of capsules as described herein.

Method of Making Capsule

The three-compartment capsules described herein can be made by any suitable method and particularly by a method as described herein. Thus a further aspect of the present invention provides a method of making capsule as described herein.

Capsule Obtained by Method of Making

A further aspect of the present invention provides a three-compartment capsule obtained by the method of making said capsule as described herein.

Mould/Cavity Section

Moulds, or cavity sections, are described herein and are characterised in having cavities configured so as to provide the three-compartment capsules described herein. Thus, a further aspect of the present invention provides a mould or cavity section for use in making a capsule as described herein, characterised in that the cavities of the mould or cavity section configured so as to produce the shape and configuration of compartments of those capsule.

In a further aspect there is provided a mould for use in a process of making capsules as described herein, or for mounting to the rotating surface of a rotary cylindrical drum as described herein, wherein the mould comprises a set of cavities, the set of cavities comprising a first side cavity, a central cavity, and a second side cavity, the first and second side cavities being located on opposite sides of the central cavity such that the central cavity is flanked by respective first and second side cavities, and wherein the mould is hexagonal so as to permit tessellation of a plurality of identical moulds so as to form a tessellated array of moulds.

In embodiments the central cavity is substantially elongate, and the long axis of the central cavity is aligned perpendicular to a pair of opposing sides of the hexagon.

Drum with Array of Hexagonal Moulds/Cavity Section

As described herein, the hexagonal shape of the capsule, and the associated moulds/cavity section permits tessellation when arranged on a surface and that in turn minimises wastage of water-soluble film. Thus, a further aspect of the present invention provides a rotary cylindrical drum comprising an array of hexagonal moulds or cavity sections as described herein.

In embodiments the rotary cylindrical drum having an outer surface which in use is a rotating surface that rotates in a process direction, wherein the outer surface has mounted thereon an array of moulds, each mould having a hexagonal shape, the moulds being tessellated such that each hexagonal-shaped mould has a pair of opposing sides aligned perpendicular to the process direction Use of Hexagonal Cutting Pattern in Capsule Production Hexagonal shaped capsules and their production is described herein. Thus, a further aspect of the present invention provides use of a hexagonal cutting pattern in the manufacture of multi-compartment, suitably three-compartment capsules.

Combinations of Aspects

A number of proposals and aspects are described herein, which proposals and aspects are intended to be combined to achieve improved or cumulative benefits. Thus, any one aspect may be combined with any other aspect. Similarly the optional features associated with any one of the aspects may apply to any one of the other aspects.

DESCRIPTION OF EMBODIMENTS

The invention will now be further described with reference to the following non-limiting embodiments and with reference to the drawings, of which:

Each of the figures will now be discussed in turn.

Figure 1:
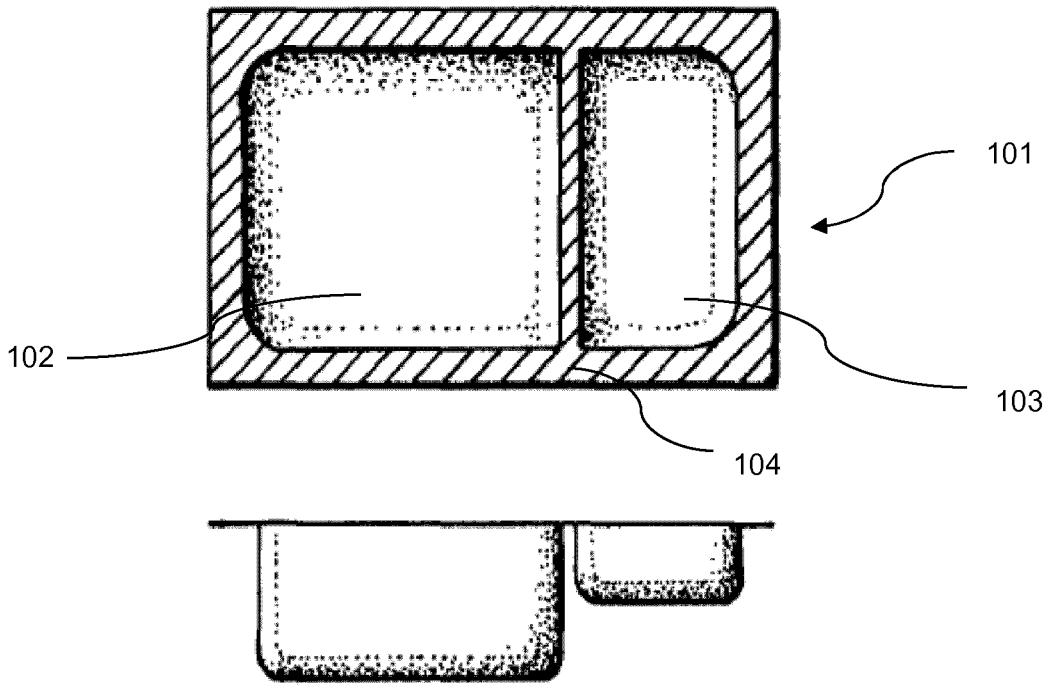
Prior Art Figure 1
FIG. 1 is a prior art two-compartment capsule, being a reproduction of FIG. 1A of EP1394065.
Figure 2:
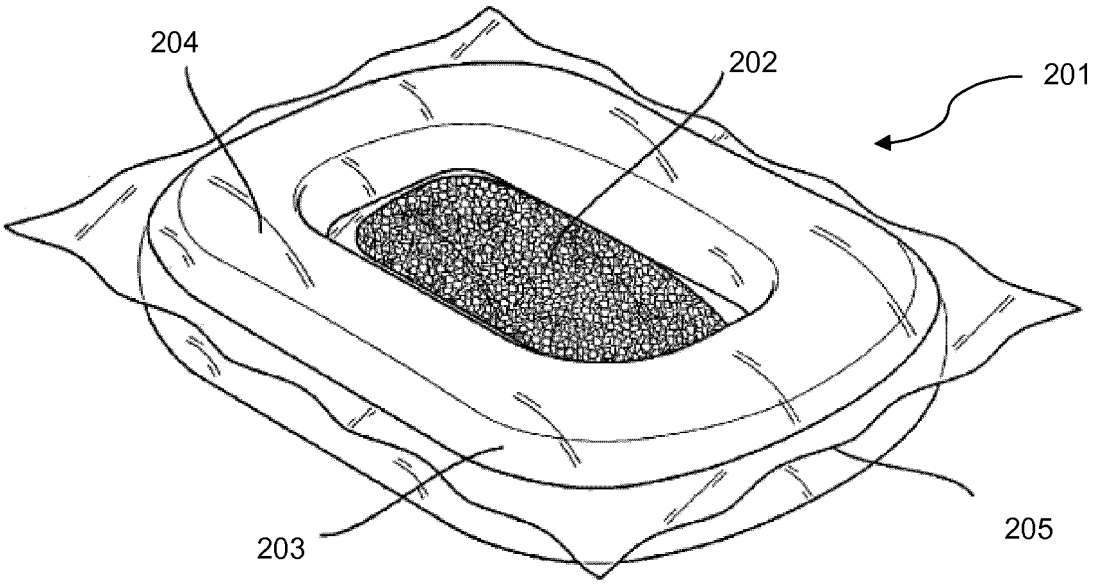
Prior Art Figure 2
FIG. 2 is a prior art two-compartment capsule, being a reproduction of FIG. 7 of WO2014/202412.
Figure 3:
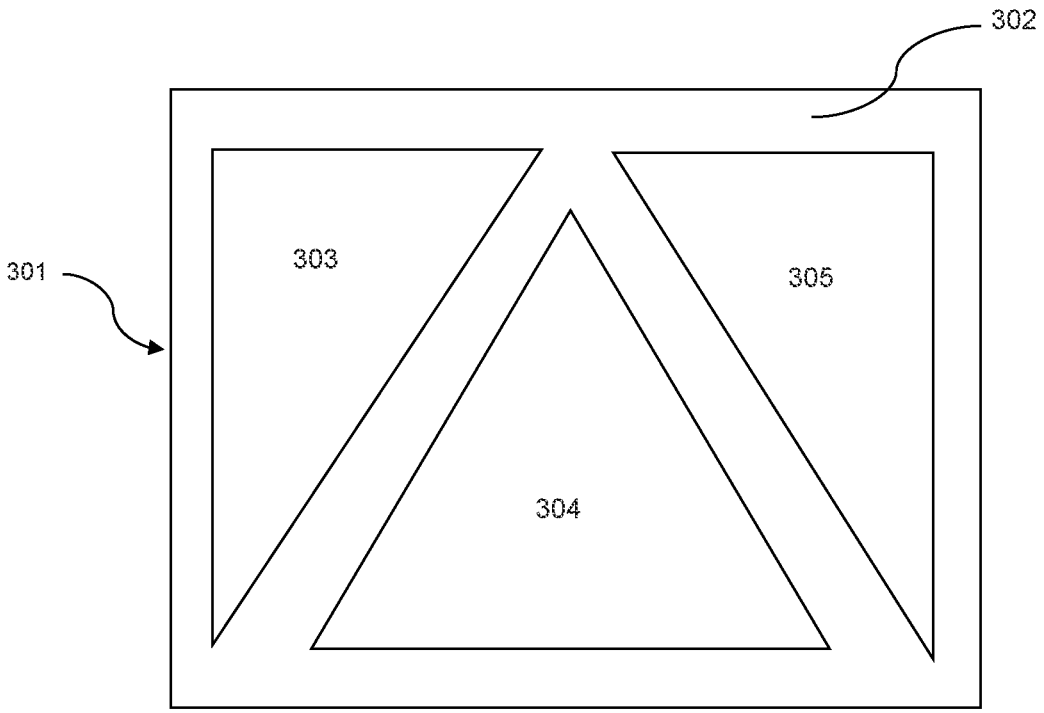
Prior Art Figure 3
FIG. 3 is a schematic representation of a prior art three-compartment capsule available from El Corte Ingles (Spain)

FIGS. 1, 2 and 3 have already been discussed. Similarly, FIG. 4 has already been discussed.

Figure 4:
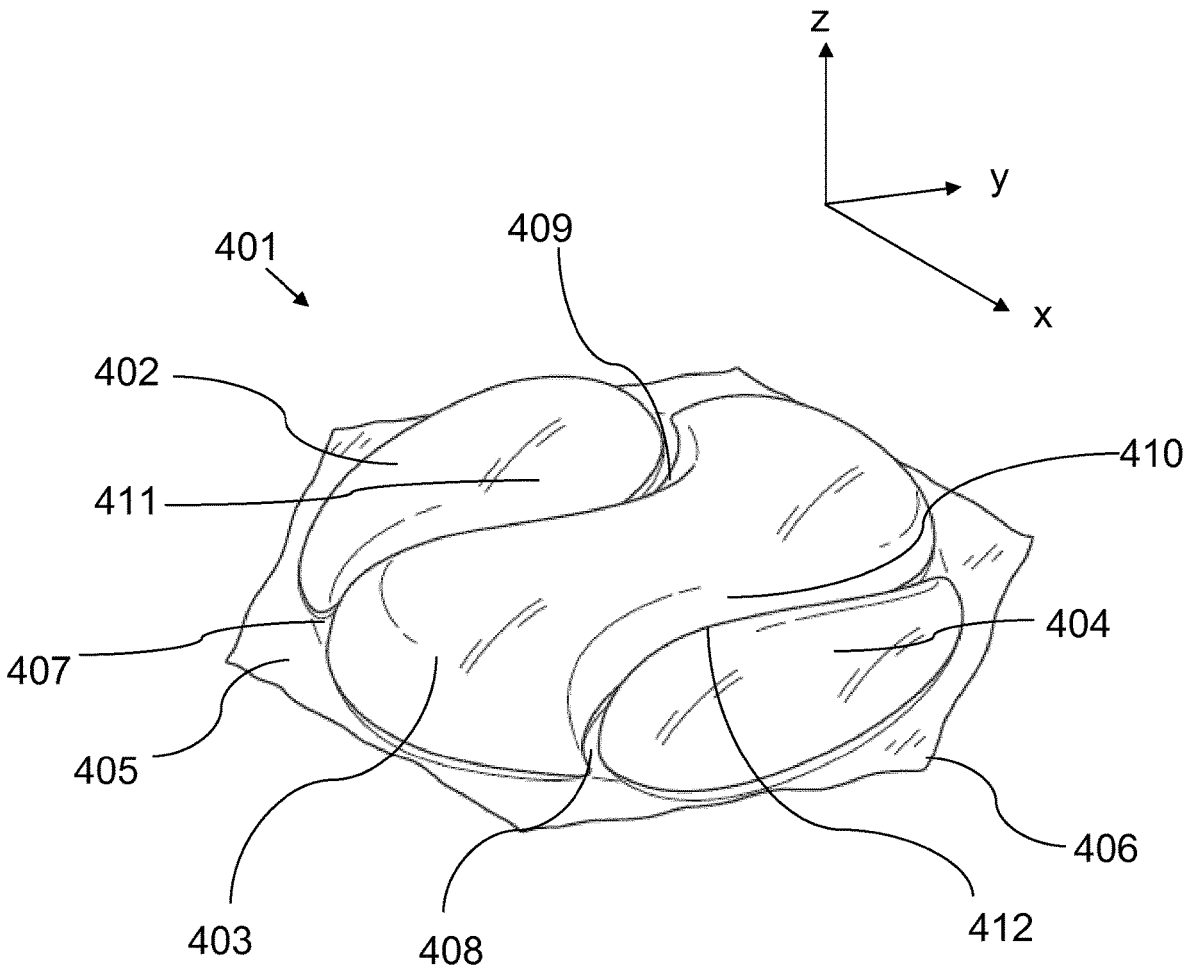
FIG. 4 is a perspective view of a capsule in accordance with the present invention.
Figure 5:
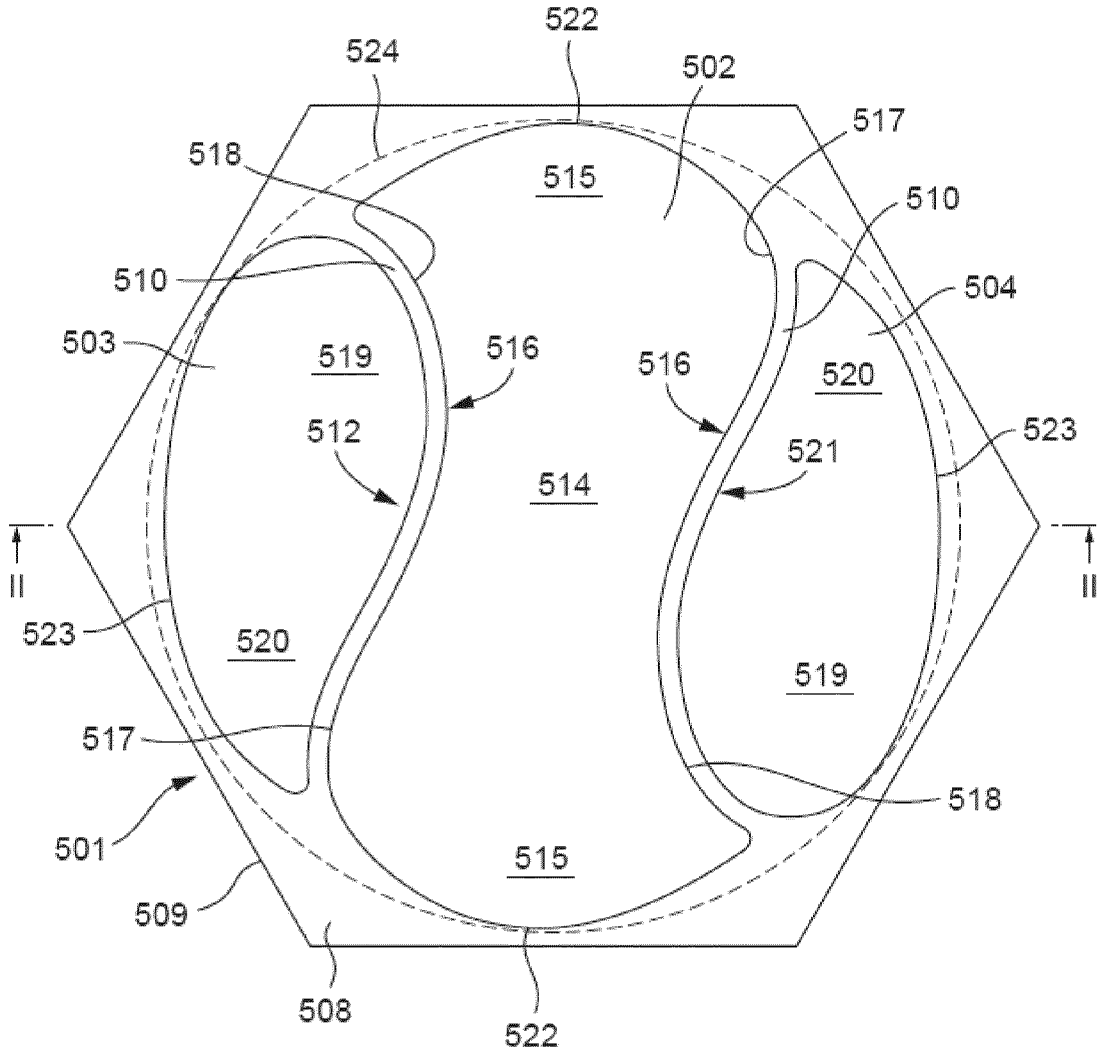
FIG. 5 is a top plan view of a capsule in accordance with the present invention.
Figure 6:
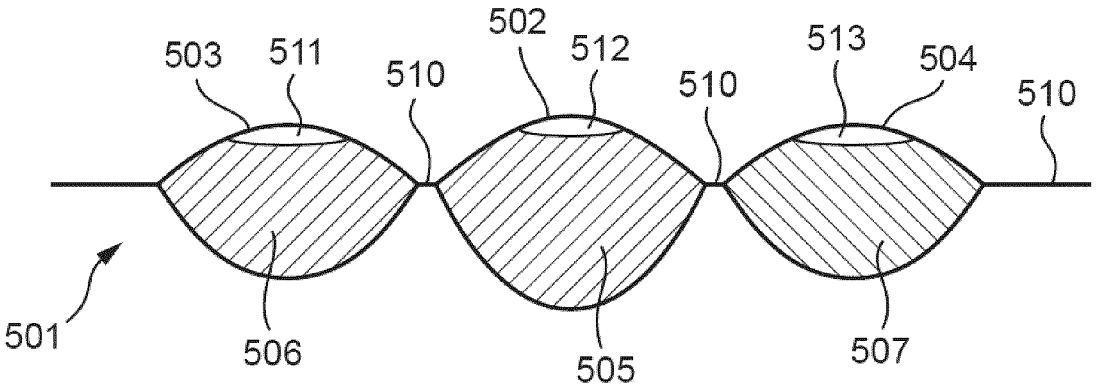
FIG. 6 is a cross-sectional view of the capsule illustrated in FIG. 5, taken along line II-II in FIG. 5.
Figure 7:
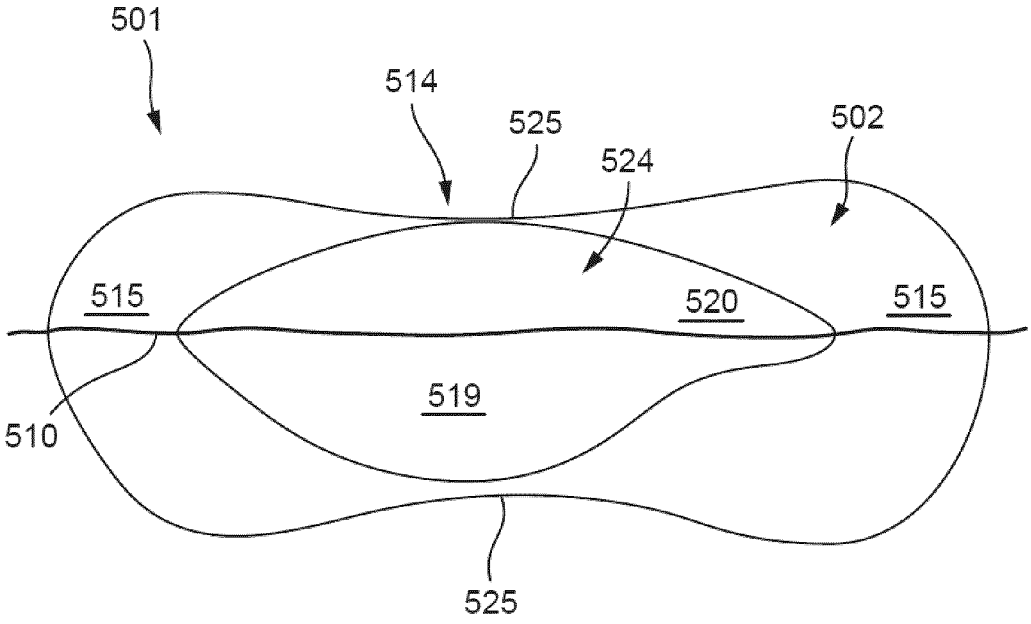
FIG. 7 is a side elevational view of the capsule illustrated in FIGS. 6 and 7.

Turning now to consider FIGS. 5 to 7, there is illustrated a further capsule 501 in accordance with the present invention, which capsule is largely identical to that the capsule shown in FIG. 4.

The capsule 501 comprises three discrete compartments 502, 503, 504, each of which defines a respective substantially liquid-tight and hermetically sealed chamber containing a respective volume 505, 506, 507 of liquid product, as denoted schematically by the cross-hatched areas in FIG. 6. The compartments are arranged adjacent one another, side-by-side in a notional row, as will be described in more detail hereinafter. A central compartment 502 is thus located between a pair of side compartments 503, 504.

As will be appreciated, each compartment 502, 503, 504 is defined between the upper and lower layers of PVA film, and is sealed around its respective periphery by the fusion of the two layers of film therearound. More particularly, and having regard to FIG. 5, it will be noted that the upper and lower film layers are fused together around the three compartments to form a generally annular web 508 extending around all of the compartments 502, 503, 504, and which has a hexagonal outer edge 509, as defined by the aforementioned cutting process. The upper and lower film layers are also fused together to form a pair of thin additional webs 510 which are formed integrally with the annular web 508 and which extend across the capsule 501 in spaced-relation to one another. Each of the additional webs 510 serves to separate the central compartment 502 from a respective side compartment 503, 504.

As will be noted most clearly from FIG. 5, the central compartment 502 is substantially larger than the two side compartments 503, 504. The central compartment 502 may thus be considered to define a primary chamber, whilst the two side chambers 503, 504 may be considered to define respective secondary chambers. It is envisaged that in some embodiments, the two side compartments 503, 504 may be of equal size and volume. In the particular embodiment illustrated, the central compartment 502 is configured to hold a larger volume of liquid product 505 than each of the two side compartments 503, 504. In particular embodiments, it is envisaged that the volume of liquid product 5 provided within the central compartment 502 may be approximately three times greater than the volume of liquid detergent product 506, 507 provided in each of the side chambers 503, 504. As illustrated in FIG. 6, a respective small volume of air 511, 512, 513 may become trapped inside each compartment 502, 503, 504 during the manufacturing process.

As shown most clearly in FIG. 5, the central compartment 502 has a somewhat S-shaped profile in plan view, defining a relatively narrow central region 514 which interconnects a pair of relatively wide end regions 515. The relatively narrow central region 514 is defined between a pair of opposed side edges 516 of the central compartment, the side edges 516 being defined by the respective additional webs 510, Each of the side edges 516 are shaped so as to comprise a respective convex portion 517 and a respective concave portion 518. The concave portion 518 of each side edge 516 serves to define a recess along each side of the central compartment 502.

As also shown most clearly in FIG. 5, each side compartment 503, 504 is shaped so as to locate, at least partially, within a respective one of the above-mentioned recesses defined along the sides of the central compartment 502. In this regard, it is to be noted that each side compartment 503, 504 has a somewhat teardrop-shaped profile in plan view, defining a relatively bulbous region 519 at one end, and a relatively narrow and somewhat pointed region 520 at the opposite end. Because the central compartment 502 is somewhat S-shaped in profile as described above, in order to locate within the aforementioned recesses, the two side compartments 503, 504 are inverted relative to one another such that the bulbous region 519 of the left-hand side compartment 503 is located adjacent one end region 515 of the central compartment 502, and the bulbous region 519 of the right-hand side compartment 504 is located adjacent the opposite end region 515 of the central compartment 502. As will thus be noted, the bulbous region 519 of each side compartment is positioned adjacent the concave region 518 of a respective side edge 516 of the central compartment 502, whilst the opposite pointed region 520 of each side compartment is positioned adjacent the convex region 517 of the respective side edge 516 of the central compartment 502. Respective inwardly directed side edges 521 of the two side chambers 503, 504 are arranged adjacent, and in facing relation to, the side edges 516 of the central compartment 502 and have a substantially identical profile, such that the additional webs 510 of fused material which separate each side compartment 503, 504 from the central compartment 502 are of substantially uniform width along their length.

The central compartment 502 presents a pair of outwardly directed end edges 522 at its oppositely directed ends, and each side compartment 503, 504 presents a respective outwardly directed side edge 523. Because of the above-described manner in which the teardrop-shaped side chambers 503, 504 locate at least partially within the recesses formed along the sides of the S-shaped central compartment 502, it will thus be appreciated that the outwardly directed edges 522, 523 of the compartments cooperate in a generally contiguous and approximate manner to define a notional circle 524, as denoted in phantom in FIG. 5.

Turning now to consider FIG. 7, the capsule 501 is illustrated in side profile. As will be noted, the end regions 515 of the central compartment 502 are somewhat larger in vertical dimension than the central region 514, due to the fact that the end regions 515 are of course more volumous than the central region 514. A small depression or recess 525 is thus formed on the top and the bottom of the central compartment 502.

As also illustrated in FIG. 7, each side chamber 503, 504 (only one being shown in FIG. 3) is configured such that its maximum depth in side profile coincides with its bulbous, and thus most volumous, region 519. The side chambers 503, 504 each narrow in side profile depth from the bulbous region to the relatively narrow and somewhat pointed end region 520. In preferred embodiments, it is envisaged that the maximum side profile depth of each side chamber 503, 504 will be less than or substantially equal to the minimum side profile depth of the central chamber 502, as illustrated.

Production

Figure 8:
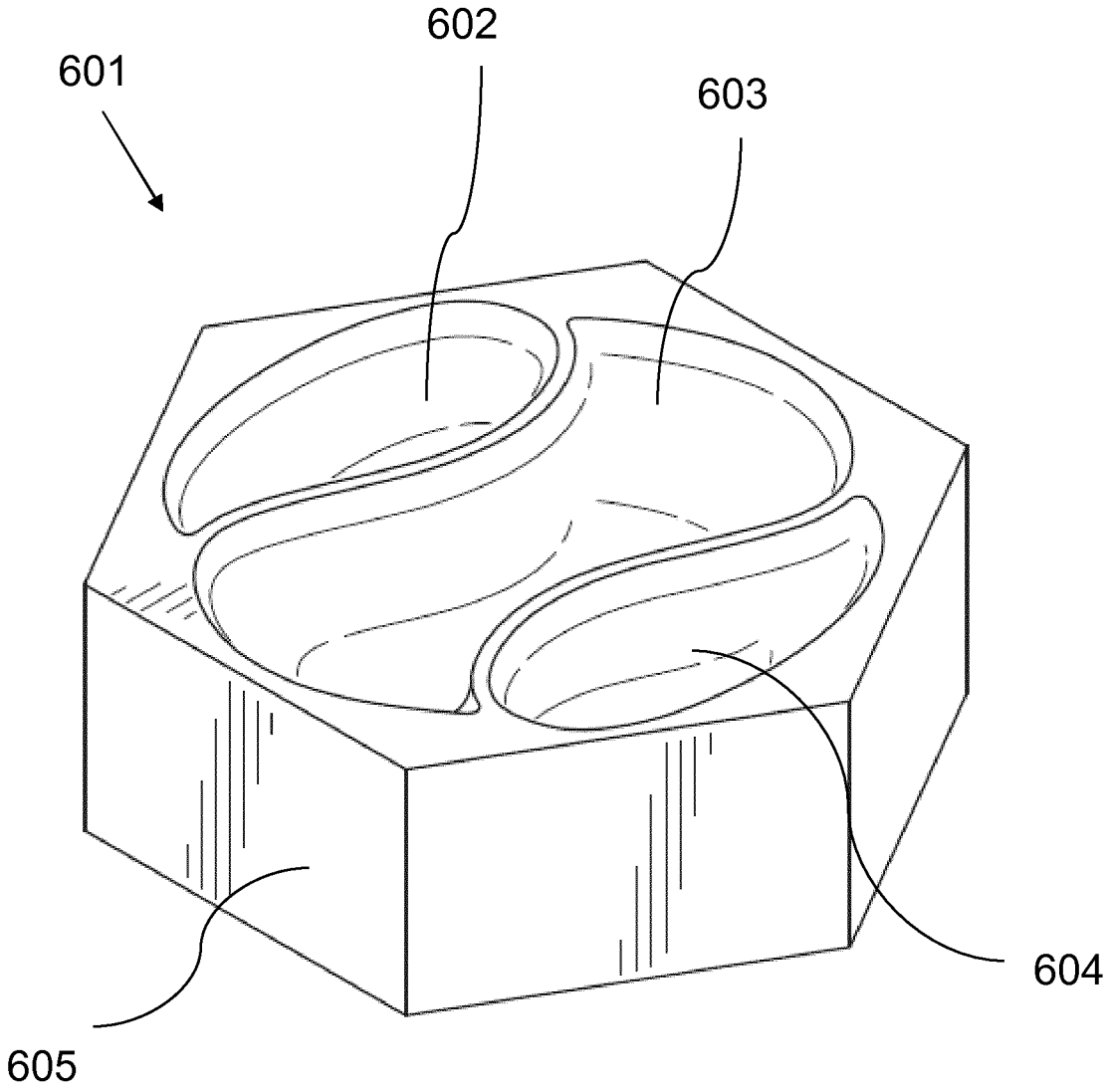
FIG. 8 is a perspective view of a three-cavity mould in accordance with the present invention.

FIG. 8 shows a mould or cavity section 601 used to thermoform a first film to manufacture a three-compartment capsule of the present invention. The mould 601 has a hexagonal shape (six equal length external side walls 605 defining a hexagon), which permits it to tessellate in a hexagonal array of identical moulds. The mould has a first teardrop-shaped side cavity 602, an S-shaped central cavity 603, and a second teardrop-shaped side cavity 604. The second teardrop-shaped cavity 602 is inverted with respect to the first teardrop-shaped cavity 603. Each cavity is provided with a number of ducts (not shown) to which may be applied a vacuum.

Figure 9:
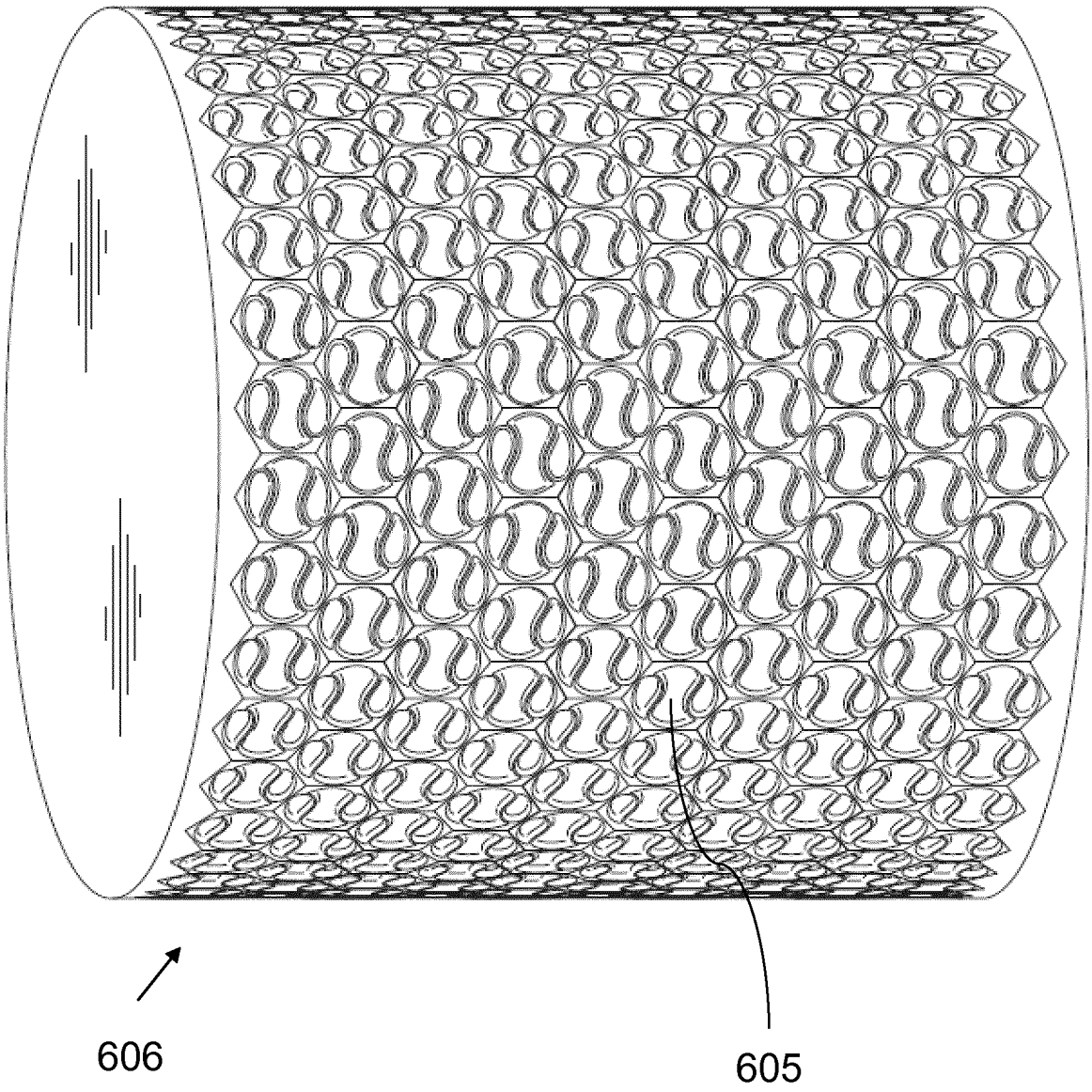
FIG. 9 is a perspective view of a rotary cylindrical drum comprising an array of hexagonal moulds on the surface.

FIG. 9 shows a plurality of such hexagonal moulds/cavity sections 601 arranged in a regular array on the outside of a rotary cylindrical drum 606. The hexagonal moulds are arranged in columns.

Figure 10:
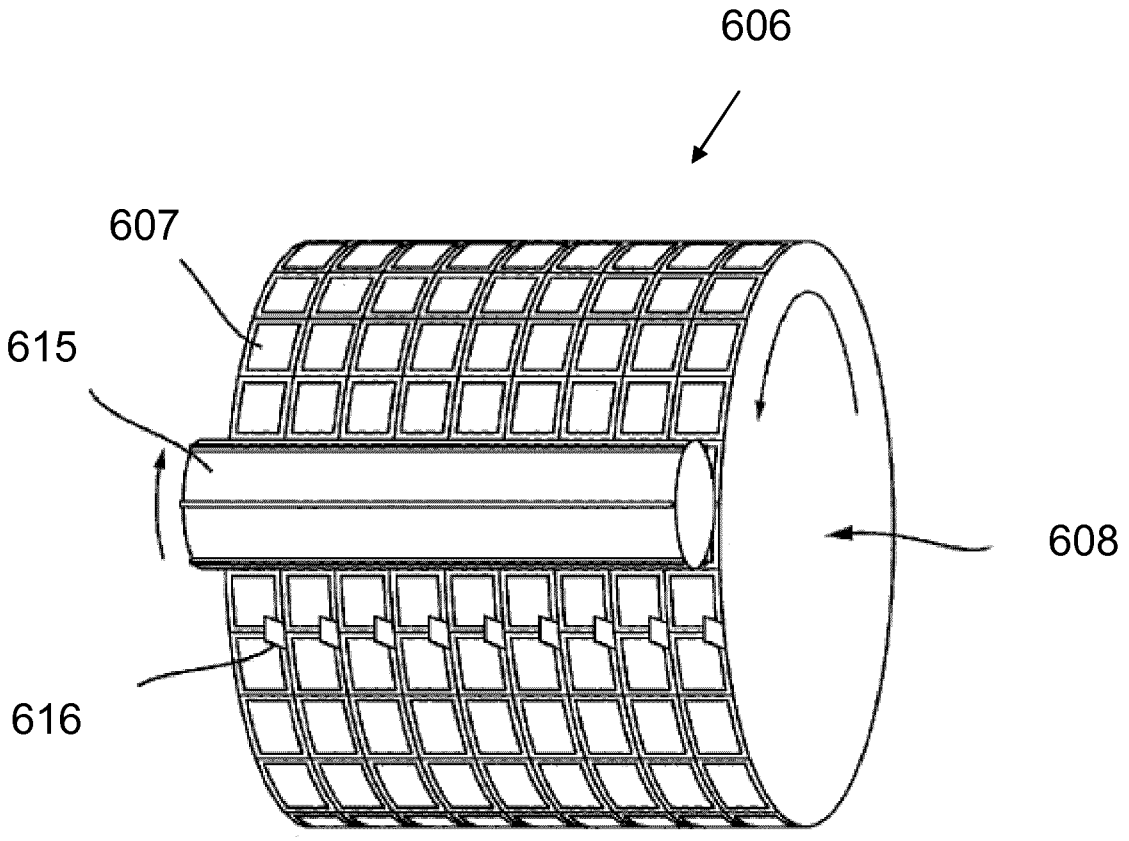
FIG. 10 is a alternate perspective view of the rotary cylindrical drum of FIG. 9.

FIG. 10 shows the rotary cylindrical drum 606 of FIG. 9 from a different perspective. Here the array 607 is illustrated schematically with simple squares. The drum has a horizontal axis 608.

Figure 11:
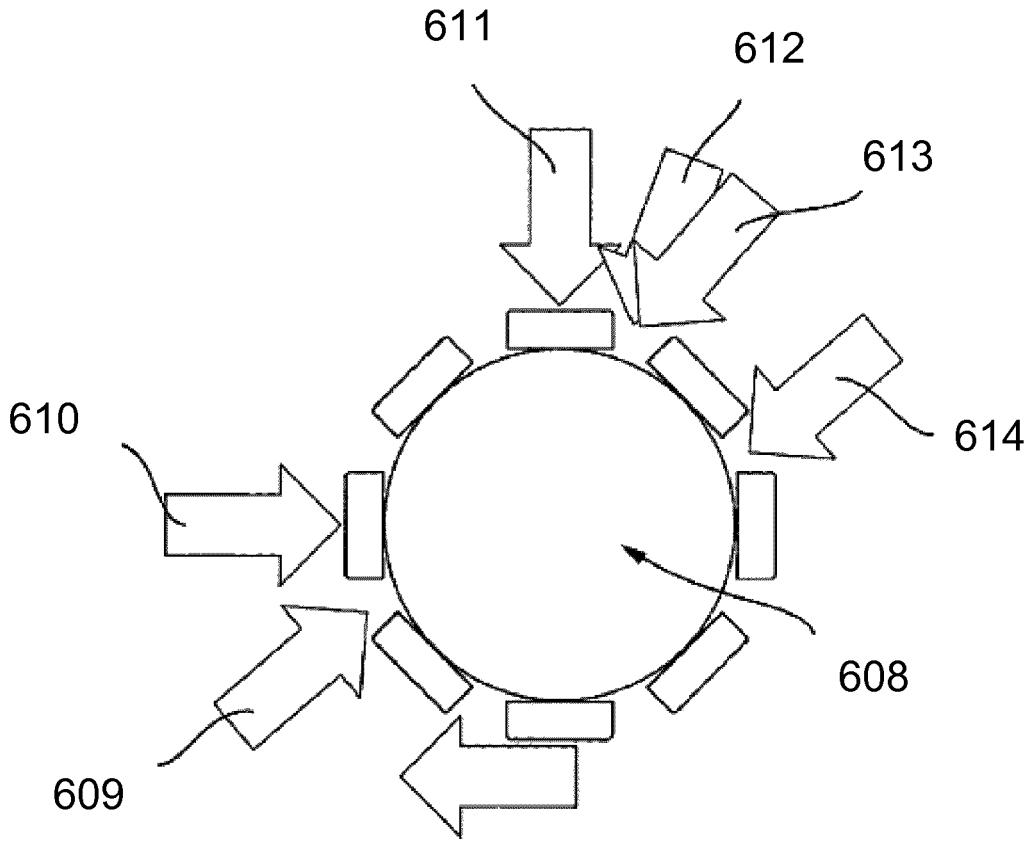
FIG. 11 is a side view of the rotary cylindrical drum of FIG. 10.

FIG. 11 shows the rotary cylindrical drum 606 from the side. The first film 609 is fed from a supply roll (not shown) over a heating roller (not shown) which has a nominal surface temperature of between 90 and 150° C. When the first film used is for example Aicello PT90 the heating roller temperature is maintained between 120 and 140° C. Immediately after passing over the heating roller, the hot base film is fed onto the cavity section which is part of an array of such moulds around a rotary drum.

Rotation of the cylinder so the cavities reach point 610 ensures that the heated first film fully covers the cavities in the cavity section. At point 705 a vacuum is then applied to the cavity section through its ducts. The vacuum is applied simultaneously to all the ducts. The vacuum pulls the first film into the cavities 602, 603 and 604 (as shown in FIG. 8) and holds it there. The film typically retains some elasticity at this stage. This leads to a tighter capsule which is preferred for ongoing line handling and robustness as well as consumer perception.

Once the cavities are thermoformed and held in place with the vacuum, the three compartments 602, 603, 604 are filled. Filling is done at the apex of the cylinder 611.

The liquid composition dispensed to each of the three compartments is as follows:

| Side compartment #1 | Central compartment | Side compartment #2 |
|---|---|---|
| Surfactant | Surfactants | Surfactants |
| Polymer cleaning | Polymer cleaning | Polymer cleaning |
| Sequestrant | Sequestrant | Sequestrant |
| Water | Enzymes | Water |
| Hydroptrope | Fluorescer | Hydrotrope |
| Opacifier | Water | Dyes |
| | Hydrotrope | |
| | Dyes | |
| | Perfume | |

In other embodiments, the composition of side compartment #1 was modified so as to include encapsulated perfume.

The composition of side compartment #1 is formulated, including through the use of an opacifier, so as to provide a white opaque composition. The central compartment is formulated, including provision of suitable dyes, to provide a blue colour. Side compartment #2 is formulated, including provision of suitable dyes, to provide a purple colour.

Fill volume vs. brimful volume is aimed at a minimum of 80%. For example, for a 28 ml liquid fill the cavity volume is thus at most 35 ml.

The volume of side compartment #1 is approximately 6 ml. The volume of side compartment #2 is also approximately 6 ml. The volume of the central compartment is approximately 18 ml.

Figure 12:
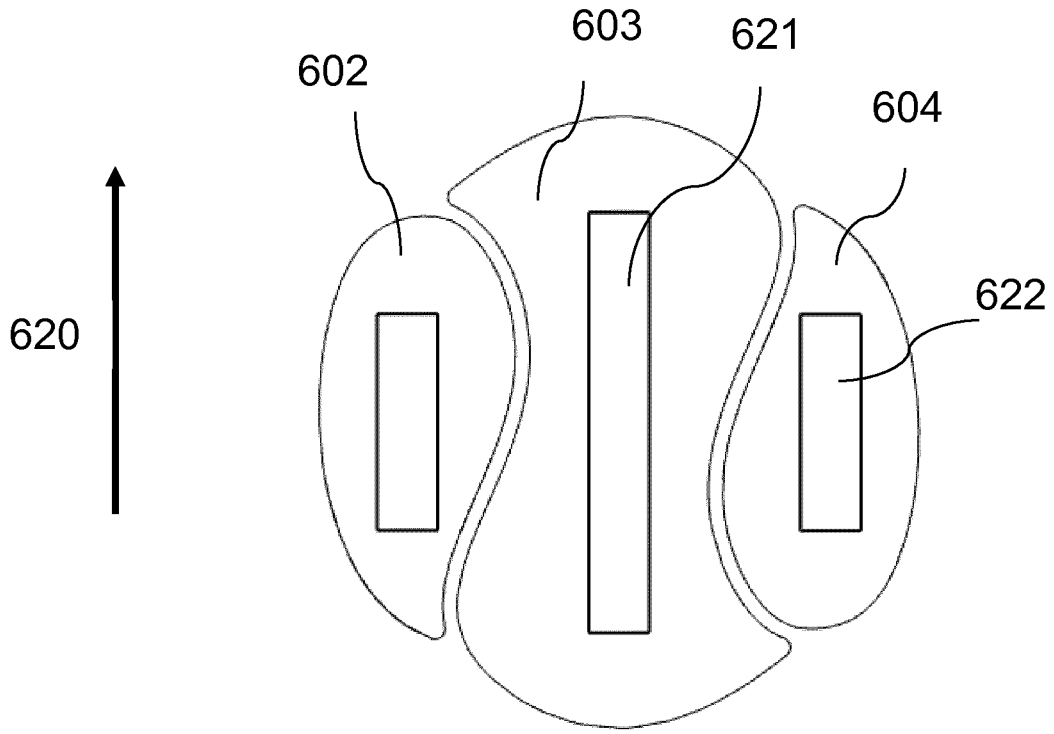
FIG. 12 is a schematic illustration of the configuration of cavities in the mould of FIG. 8.

Filing of the central compartment 603 starts shortly before filling of the side compartments. This is done because the central compartment arrives under the filling station at the apex 611 just before the side compartments, by virtue of the central compartment being longer than the side compartments, and the orientation of the compartments with respect to the drum rotation direction such that the long axis of the compartments is aligned with the drum rotation direction, as shown in FIG. 9. The alignment of the three compartments (strictly the three cavities that will form the compartments) is also shown in FIG. 12.

The filling station provides three filing nozzles, each one addressing respective first side, central and second side compartments.

The three filling nozzles are arranged side-by-side in a line, which line is perpendicular to the drum rotation direction.

In other arrangements, one of the filling nozzles may be stepped forward or backward from the line, for example by a distance that corresponds to the spacing, in the drum rotation direction, between the leading edges of the side and central compartments. For example, the central compartment filling nozzle may be stepped back from the two side compartment filling nozzles such that the leading edge of each of the three compartments arrives under their respective filling nozzles at substantially the same time.

In the case of the preferred in-line arrangement, the central compartment will arrive under its filling nozzle earlier than will the respective side compartments. This can be understood from FIG. 12, where the direction of travel 620 is shown. Thus, advantageously, filling of the central compartment can commence before filling of the side compartments. To facilitate this, the central compartment filling nozzle is controlled so that it can operate (i.e. dispense liquid composition) independently of the side compartment filling nozzles. Alternatively or additionally the operation of the central compartment filling nozzle is controlled so that it begins dispensing at a different time, suitably before and suitably a predetermined time before, the side compartment filling nozzles. The operation of the central and side compartment nozzles may therefore be synchronised to provide this staggered (in time) dispensing.

The apparatus comprises a nozzle control system configured to provide said control of the central compartment filling nozzle.

Similarly, the length of time for which the central compartment filling nozzle is activated (i.e. is dispensing liquid composition) may be controlled so as to be different to the corresponding activation time (dispensing time) of the side compartment filling nozzles.

In particular, taking into account the larger volume and/or greater length (aligned with the drum rotation direction) of the central compartment as compared to the side compartments (see FIG. 12), the central compartment filling nozzle is controlled so as to have a longer activation (dispensing) time. This permits, for example, the central compartment to be filled for longer, and hence deposit a larger amount of liquid composition. Thus, a longer "fill zone" 621 for the central compartment 603 is achieved as compared to the fill zone 622 for the side compartments 602, 604, as shown in FIG. 12.

Figure 13:
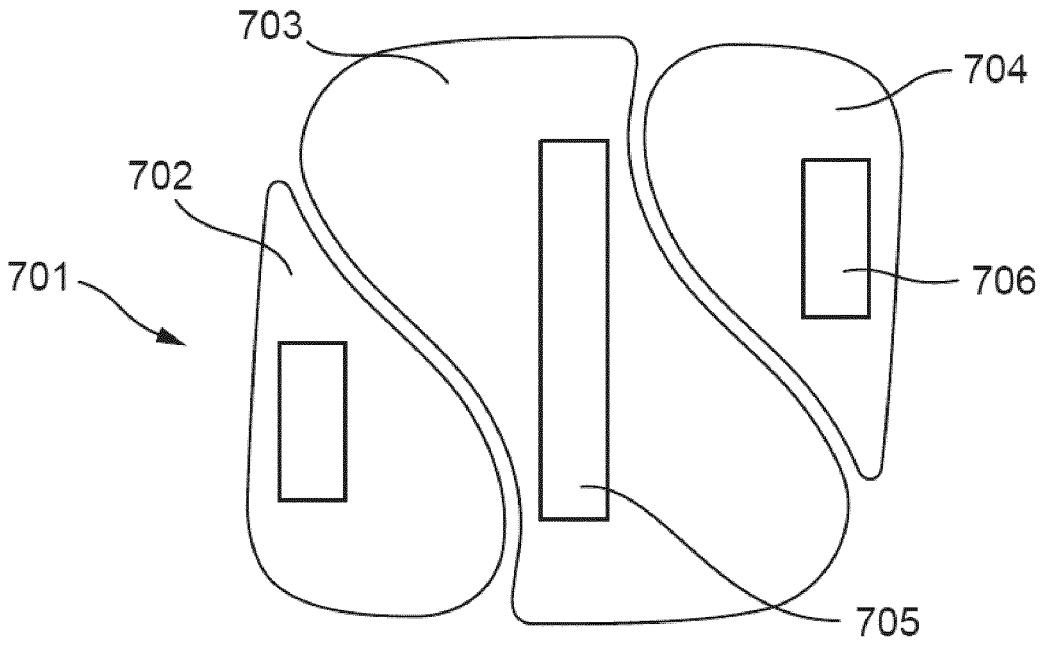
FIG. 13 is a schematic illustration of an alternative configuration of cavities in a mould.

An alternative capsule (mould) arrangement 701 is shown in FIG. 13, whereby the three compartments 702, 703, 704 have the same general configuration and relationship as discussed for FIG. 12, such that the fill zone 705 for the central compartment 703 is considerably longer than the fill zone 706 for the side compartments 702, 704. Again, this achieved by independent control of the filling nozzles.

As described herein, the fill rate for the central compartment filling nozzle may be different from, for example greater than, the fill rate of the side compartment filling nozzles.

Returning to FIG. 11, immediately after filling of the liquid compartment the second film 612 is brought into position over the filled cavities. Immediately before this the second film has been passed through a water bath (not shown). This makes the lower surface of the second film 612 wet which acts as the mechanism for sealing the second film to the first film where it contacts it; thus forming the seal areas. The second film is a similar type to that used for the first film but is the slightly thinner, for example 60 micron Aicello. The seal area is made secure by pressure application of a sealing roller at position 613.

Post sealing, the filled capsule is cut from the sheet at position 614. This is achieved by horizontal and inclined cuts from cylindrical cutter 615 (shown in FIG. 10). Thus, the horizontal cuts correspond to the horizontal (perpendicular to the direction of travel) opposing sides of the hexagons as shown in FIG. 9, and the included cuts correspond to the other tow pairs of opposing sides, being inclined as shown in FIG. 9. For those embodiments where a square or rectangular footprint is desired, only horizontal cuts may be provided by the cylindrical cutter 615. Vertical cuts, if required (e.g. for square cutting pattern) are provided by static knife blades 616.

The invention claimed is:

1. A three-compartment water-soluble capsule, each compartment containing a part of a liquid detergent composition, the three compartments being arranged side-by-side to provide a central compartment flanked on respective sides by a first side compartment and a second side compartment, the capsule being formed from two sheets of water-soluble film, the two sheets of film being sealed together to form a sealing web around each compartment, the sealing web lying in a sealing plane, each of the three compartments extending at a maximum the same distance above and below the sealing plane, wherein the sealing web comprises an annular sealing web defining the periphery of the capsule, and two internal sealing webs which each extend across the capsule in a machine direction, each internal sealing web serving to connect the central compartment with an adjacent side compartment and to separate the contents of the central and adjacent side compartments, wherein each internal sealing web has a curved shape, wherein each internal sealing web is free of straight portions, wherein the spacing between the two internal sealing webs decreases as the internal sealing web traverses the capsule from an outer position where the spacing is integral with the annular sealing web to a radially inner position at the midpoint of the length of the internal sealing web.

2. A three-compartment water-soluble capsule according to claim 1, wherein at least a portion of each internal web has a curved profile whose radius of curvature is in the range 12 mm to 22 mm.

3. A three-compartment water-soluble capsule according to claim 1, wherein the width of each internal sealing web is constant and wherein the width of each internal sealing web is ≤3 mm.

4. A three-compartment water-soluble capsule according to claim 1, wherein the extent of reduction of spacing between the two internal sealing webs is in the range 6 to 12 mm.

5. A three-compartment water-soluble capsule according to claim 1, wherein the capsule has second order rotational symmetry.

* * * * *